US008474941B2

(12) United States Patent
Tanaka et al.

(10) Patent No.: US 8,474,941 B2
(45) Date of Patent: Jul. 2, 2013

(54) INKJET PRINTING APPARATUS AND INKJET PRINTING METHOD

(75) Inventors: Hirokazu Tanaka, Kawasaki (JP); Hidehiko Kanda, Yokohama (JP); Wakako Yamamoto, Sagamihara (JP); Kenichi Oonuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 646 days.

(21) Appl. No.: 12/419,041

(22) Filed: Apr. 6, 2009

(65) Prior Publication Data

US 2009/0256879 A1 Oct. 15, 2009

(30) Foreign Application Priority Data

Apr. 10, 2008 (JP) ..... 2008-102406

(51) Int. Cl.
*B41J 29/38* (2006.01)

(52) U.S. Cl.
USPC ..... 347/17; 347/19; 347/60

(58) Field of Classification Search
None
See application file for complete search history.

(56) References Cited

U.S. PATENT DOCUMENTS

| | | | | |
|---|---|---|---|---|
| 5,424,767 | A * | 6/1995 | Alavizadeh et al. | 347/17 |
| 5,467,113 | A * | 11/1995 | Ishinaga et al. | 347/17 |
| 6,435,660 | B1 | 8/2002 | Ozaki et al. | |
| 6,827,416 | B2 | 12/2004 | Matsumoto et al. | |
| 7,219,971 | B1 | 5/2007 | Shirota et al. | |
| 7,438,374 | B2 | 10/2008 | Shibata et al. | |
| 2007/0159512 | A1 | 7/2007 | Shirota et al. | |
| 2007/0291065 | A1 | 12/2007 | Shibata et al. | |

FOREIGN PATENT DOCUMENTS

| | | | |
|---|---|---|---|
| JP | 11-179938 | A | 7/1999 |
| JP | 2006-334967 | A | 12/2006 |
| JP | 2007-331352 | A | 12/2007 |

* cited by examiner

*Primary Examiner* — Uyen Chau N Le
*Assistant Examiner* — Chad Smith
(74) *Attorney, Agent, or Firm* — Fitzpatrick, Cella, Harper & Scinto

(57) ABSTRACT

There are provided an inkjet printing apparatus and an inkjet printing method, whereby, the temperature of a print head is controlled and the ejection volume of ink to be ejected is stabilized to print a high-quality image, even at a high printing duty. Based on print data, an ejection number of ink to be ejected into a unit printing area is counted. The print head is heated to a target temperature that is raised in consonance with an increase in the count value.

7 Claims, 20 Drawing Sheets

| TEMPERATURE OF PRINT HEAD BEFORE SCAN Tb | EJECTION NUMBER OF 5-pl INK | | | | |
|---|---|---|---|---|---|
| | 0～432000 | 432001～864000 | 864001～1296000 | 1296001～1728000 | 1728001～2160000 |
| Tb＜46℃ | 100% | 100% | 100% | 100% | 100% |
| 46℃≦Tb＜48℃ | 80% | 90% | 90% | 95% | 100% |
| 48℃≦Tb＜50℃ | 40% | 50% | 50% | 60% | 65% |
| 50℃≦Tb＜52℃ | 10% | 15% | 15% | 15% | 20% |
| 52℃≦Tb＜54℃ | 0% | 0% | 0% | 5% | 10% |
| 54℃≦Tb | 0% | 0% | 0% | 0% | 0% |

FIG.7

| TEMPERATURE OF PRINT HEAD BEFORE SCAN Tb | EJECTION NUMBER OF 2-pl INK | | | | |
|---|---|---|---|---|---|
| | 0～432000 | 432001～864000 | 864001～1296000 | 1296001～1728000 | 1728001～2160000 |
| Tb＜46℃ | 100% | 100% | 100% | 100% | 100% |
| 46℃≦Tb＜48℃ | 90% | 80% | 75% | 70% | 75% |
| 48℃≦Tb＜50℃ | 50% | 40% | 35% | 30% | 25% |
| 50℃≦Tb＜52℃ | 20% | 10% | 5% | 0% | 0% |
| 52℃≦Tb＜54℃ | 0% | 0% | 0% | 0% | 0% |
| 54℃≦Tb | 0% | 0% | 0% | 0% | 0% |

FIG.13

| TEMPERATURE OF PRINT HEAD BEFORE SCAN Tb | EJECTION PARAMETER | | | | |
|---|---|---|---|---|---|
| | 0～432000 | 432001～864000 | 864001～1296000 | 1296001～1728000 | 1728001～2160000 |
| Tb＜48℃ | 100% | 100% | 100% | 100% | 100% |
| 48℃≦Tb＜49℃ | 80% | 90% | 90% | 95% | 100% |
| 49℃≦Tb＜50℃ | 40% | 50% | 50% | 60% | 65% |
| 50℃≦Tb＜51℃ | 10% | 15% | 15% | 15% | 20% |
| 51℃≦Tb＜52℃ | 0% | 0% | 0% | 5% | 10% |
| 52℃≦Tb | 0% | 0% | 0% | 0% | 0% |

FIG.17

| EJECTION NUMBER OF 2-pl INK d | TEMPERATURE COEFFICIENT C |
|---|---|
| 0 ~ 144000 | 0.73 |
| 144001 ~ 288000 | 0.79 |
| 288001 ~ 432000 | 0.85 |
| 432001 ~ 576000 | 0.90 |
| 576001 ~ 720000 | 0.95 |
| 720001 ~ 864000 | 0.99 |
| 864001 ~ 1008000 | 1.03 |
| 1008001 ~ 1552000 | 1.06 |
| 1552001 ~ 1296000 | 1.09 |
| 1296001 ~ 1440000 | 1.11 |
| 1440001 ~ 1584000 | 1.12 |
| 1584001 ~ 1728000 | 1.13 |
| 1728001 ~ 1872000 | 1.13 |
| 1872001 ~ 2016000 | 1.13 |
| 2016001 ~ 2160000 | 1.13 |

FIG.19

INKJET PRINTING APPARATUS AND INKJET PRINTING METHOD

BACKGROUND OF THE INVENTION

1. Field of the Invention

The present invention relates to an inkjet printing apparatus and an inkjet printing method for printing an image on a printing medium by ejecting ink from an ejection opening of a print head on the basis of print data.

2. Description of the Related Art

The level of requests submitted for the performances of printing apparatuses, such as printers, copiers and facsimile machines, has been remarkably increased in recent years, and now, entries for such requests may include not only rapid and full color printing, but also high-definition printing providing the quality equivalent to that associated with silver halide film printing. Today, an ink ejection type printing apparatus (an inkjet printing apparatus) can comply with such a request because technology permits the formation, on an inkjet print head, of an array of nozzles for the high frequency ejection of tiny ink droplets, and can thus provide superior printing speeds and printed image quality. Especially for a thermal inkjet printing apparatus, i.e., an apparatus that employs a print head in which heaters (electro-thermal converters) generate ink bubbles used to eject ink through nozzles, since nozzles can be arranged at a high density, a high resolution image can be provided.

Such a thermal inkjet printing system has the following two features.

First, in the thermal inkjet printing system, thermal energy is generated by supplying power to heaters that produce ink bubbles for ejecting ink droplets, and in the event, the growth of bubbles is greatly affected by the temperature of the ink in the immediate vicinity of the heaters. The process by which ink molecules, in a gaseous form, are released in the ink, and the process by which ink molecules, in a liquid form, are impelled to the bubble are performed at the interface between the bubble and the ink, and the temperature of the ink in the vicinity of the bubble greatly affects the performance of the second process. Therefore, when the temperature of the ink is high, since many ink molecules are released to the bubble, the bubble grows until comparatively large. On the other hand, when the temperature of the ink is low, since fewer molecules are released to the bubble, the size of the bubble produced is comparatively smaller. Thus, the size of a bubble affects the volume of ink pushed out by the bubble (hereinafter this volume of ink is called an "ejection volume"). Therefore, in the thermal inkjet printing apparatus, since the ejection volume of ink is greatly affected by the temperature of the ink near the heater, there is a tendency to increase the ejection volume when the temperature of the ink is high, and to reduce the ejection volume when the temperature is low.

In the thermal inkjet printing system, the ink temperature near the heater might become higher than before the start of printing as stated below.

Not all of the thermal energy generated by the heater contributes to the generation of bubble. The thermal energy remaining, after the energy required to generate bubble has been subtracted from the total generated, is stored as thermal energy in the surrounding ink or in the body of a print head member. As a result, the ink temperature near the heater is raised, and the stored thermal energy is released by heat transfer via a heater chip, where the heater is provided, or by the ejection of ink. However, since thermal energy is supplied by the heater during the printing operation, the temperature may continuously rise when the amount of the energy released is smaller than the amount of that supplied. On the other hand, during a non-printing operation, such as a printing medium conveying operation, in which thermal energy is not being supplied by the heater, the temperature near the heater could gradually fall until a thermodynamic equilibrium is established between the heater and its environment. Therefore, depending on the number of times individual heaters are driven, i.e., depending on the volume of the print data provided for individual nozzles, the temperature of some portions of the print head and nearby ink may be raised, while the temperature of the other portions and nearby ink may be reduced to around room temperature. Such high and low temperature portions of the print head could appear during the printing on a printing medium of a single page.

Because of the two above described features of the thermal inkjet system, when specific print data for one page are being printed on the printing medium, the temperature of the ink near the heaters may be raised in some portions and may be reduced in others, and different volumes of ink would be ejected from the nozzles in the high temperature portions and in the low temperature portions. Especially when the ejection volume is fluctuated while an image is printed on the printing medium based on print data, there is a possibility of changing the dimensions of dots formed by the ink landed on the printing medium. In this case, there is a possibility of giving rise to unevenness of the density distribution of images printed on a page to cause image deterioration.

To solve the problem of fluctuation in the ejection volume of ink due to the temperature of the print head, there is a well known method whereby the print head is maintained at a high temperature to control the fluctuation. For example, a printing apparatus disclosed in Japanese Patent Laid-Open No. 2006-334967 estimates heat exhausting effects by employing information (printing duty) about the volume of the ink required for printing and information about a temperature difference between the temperature of a print head and the temperature of the ink supplied to the print head. The change of the temperature of the print head is assumed based on the estimate, and heating power required to maintain the temperature of the print head is determined, so that the temperature of the print head is adjusted within a specific range.

However, when printing duty is high, i.e., when the ejection volume is large relative to a unit printing area, the temperature, affecting the ejection volume, of ink around the nozzle is reduced by discharging ink through the nozzle, that has a temperature lower than that of the print head. Therefore, when the temperature of the print head is maintained constant as in Japanese Patent Laid-Open NO. 2006-334967, the ink ejection volume and the ink ejection speed may fluctuate. Thus, the temperature of the print head must be set in accordance with the printing duty.

Further, in Japanese Patent Laid-Open No. 2006-334967, no description is given for a print head wherein nozzles in a plurality of sizes are formed for one ink liquid chamber. Assume that a nozzle having an ejection volume of 5-pl (pico liter) ink and a nozzle having an ejection volume of 2-pl ink are formed for one ink liquid chamber, and that the sizes of these two nozzles are different. In this case, when the ink ejection volumes of these nozzles are simply added together in accordance with the printing duty, the temperature of the print head cannot be accurately controlled. This is because the amounts of heat stored in 5 pl of ink and in 2 pl of ink are changed in accordance with the printing duty, respectively. When the printing duty is low, little heat exhausting effect can be expected when ejecting ink through the nozzles. Furthermore, more ink ejection energy is required for 5 pl of ink than for 2 pl, and a larger amount of heat is stored in the nozzle that ejects 5 pl of ink than in the nozzle that ejects 2 pl of ink. When the printing duty is increased, because greater heat exhausting effects can be obtained for nozzle that ejects 5 pl of ink, accordingly, heat stored in the nozzle can be greatly reduced, and in the end, may be less than the amount of heat stored in nozzle that ejects 2 pl of ink. Therefore, when the ink volumes ejected through the nozzles for 5 pl and 2 pl are simply added together, and the total ink volume is employed to select electric power for heating the print head from one table, temperature control for the print head is not appropriately performed.

SUMMARY OF THE INVENTION

The present invention provides an inkjet printing apparatus and an inkjet printing method which can control the temperature of a print head and stabilize the ejection volume of ink to be ejected, even when a printing duty is high, so that a high-quality image can be printed.

In the first aspect of the present invention, there is provided an inkjet printing apparatus to print an image on a printing medium using a print head that capable of ejecting ink from an ejection port based on print data, the ink jet printing apparatus comprising: a temperature detecting unit that detects a temperature of the print head; a heating control unit that controls heating of the print head; and a counting unit that counts a ejection number of ink to be ejected into a unit printing area of the printing medium based on the print data, wherein the heating control unit heats the print head to a target temperature that is raised in accordance with an increase in the count value counted by the counting unit.

In the second aspect of the present invention, there is provided an inkjet printing method for printing an image on a printing medium using a print head capable of ejecting ink from as ejection port based on print data, the ink jet printing method comprising the steps of: counting a ejection number of ink to be ejected into a unit printing area of the printing medium based on the print data; and heating the print head to a target temperature that is raised in accordance with an increase in the count value.

In the third aspect of the present invention, there is provided an inkjet printing apparatus to print an image on a printing medium using a print head that capable of ejecting ink from an ejection port based on print data, the ink jet printing apparatus comprising: a temperature detecting unit that detects a temperature of the print head; a heating control unit that controls heating of the print head; and an acquisition unit that acquires a value about an ejection volume of ink to be ejected into a unit printing area of the printing medium based on the print data, wherein the heating control unit heats the print head to a target temperature that is raised in accordance with an increase in the value acquired by the acquisition unit.

In the fourth aspect of the present invention, there is provided an inkjet printing method for printing an image on a printing medium using a print head capable of ejecting ink from as ejection port based on print data, the ink jet printing method comprising the steps of: acquiring a value about an ejection volume of ink to be ejected into a unit printing area of the printing medium based on the print data; and heating the print head to a target temperature that is raised in accordance with an increase in the value.

According to the present invention, since the temperature of the print head is raised when the ink ejection volume for each unit printing area is increased, the optimal temperature around the ejection port is maintained while taking into account the heat exhausting effects that will be accompanied by the ejection of ink, and the ink ejection volume can be stabilized. As a result, a fluctuation of the ink ejection volume can be restricted, and a high-quality image can be provided.

Further features of the present invention will become apparent from the following description of exemplary embodiments (with reference to the attached drawings).

BRIEF DESCRIPTION OF THE DRAWINGS

FIG. 7 is a diagram for explaining a drive duty table for a sub-heater in the first embodiment of the present invention;

FIG. 13 is a diagram for explaining a drive duty table for a sub-heater for the second embodiment of the present invention;

FIG. 17 is a diagram for explaining a drive duty table for a sub-heater in the third embodiment of the present invention;

FIG. 19 is a table for explaining temperature coefficients for the third embodiment of the present invention;

DESCRIPTION OF THE EMBODIMENTS

The preferred embodiments of the present invention will now be described while referring to the accompanying drawings. It should be noted that the following embodiments are examples applied for an inkjet printing apparatus.

First Embodiment

Figure 1A:
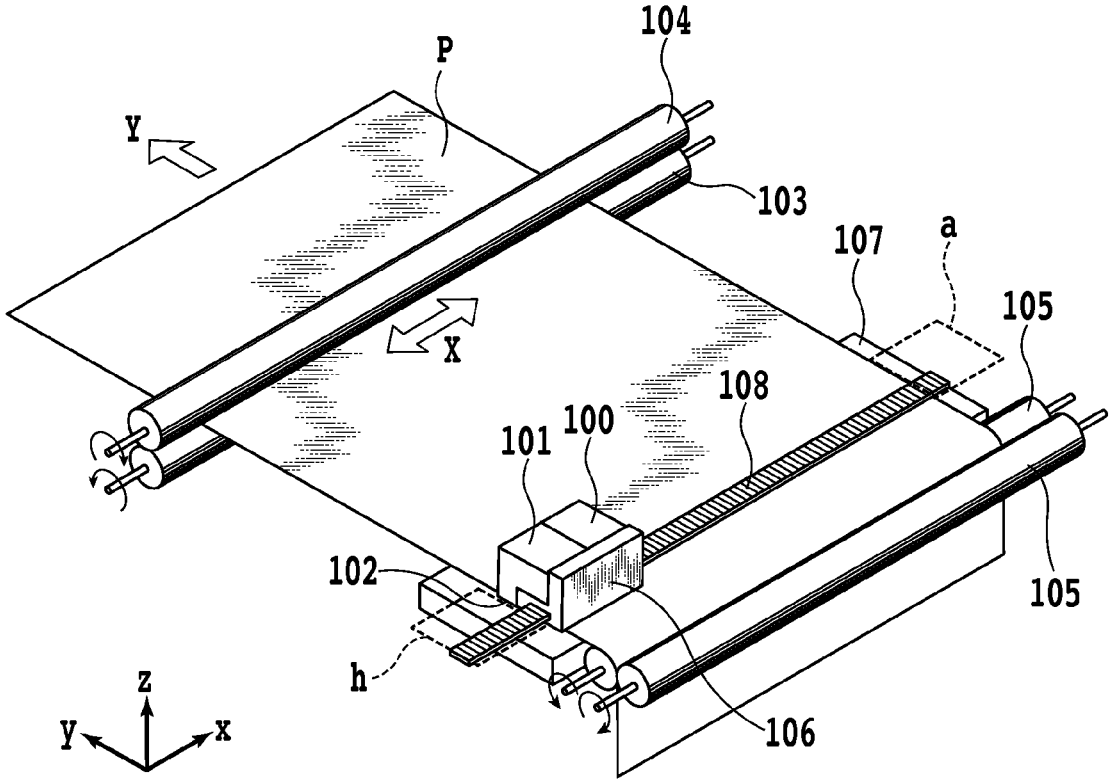
FIG. 1A is a perspective view of an essential portion of an inkjet printing apparatus according to a first embodiment of the present invention.
Figure 1B:
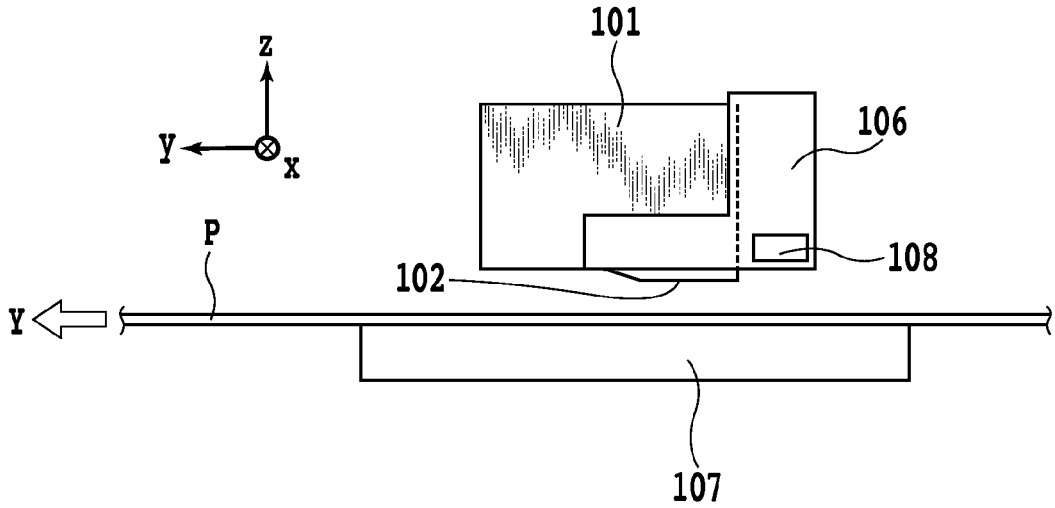
FIG. 1B is a side view of a print head portion in FIG. 1A.

FIG. 1A is a schematic perspective view of an inkjet printing apparatus, and FIG. 1B is a side view of a print head portion of the inkjet printing apparatus.

Each of inkjet print heads 100 and 101 constitutes an inkjet cartridge with which ink tanks are packaged. It should be noted, however, that the print heads are not limited to the type with which ink tanks are packaged, as in this embodiment. Three ink colors, i.e., black, light cyan and light magenta, are stored in the ink tanks provided for the print head 100, while three other ink colors, i.e., cyan, magenta and yellow, are stored in the ink tanks provided for the print head 101. The same structure is employed for both print heads 100 and 101, and only the ink stored in the ink tanks provided for the two print heads differs. The print heads 100 and 101 include head chips 102 wherein a plurality of ink ejection ports are arranged.

A conveying roller 103 and an auxiliary roller 104 hold a printing medium P and respectively rotate in the directions indicated by arrows to convey the printing medium P in a sub-scan direction indicated by an arrow Y. A pair of feed rollers 105 feed the printing medium P, and hold the printing medium P similar to the rollers 103 and 104.

A carriage 106, on which the print heads 100 and 101 are mounted, is reciprocally moved in a main scan direction indicated by an arrow X, across (in this embodiment, perpendicular to) the sub-scan direction. During a non-printing operation or a print head recovery operation, the carriage 106 is moved to and remains at a home position h indicated by a broken line in FIG. 1A. A platen 107 is located at the printing position to support the printing medium P, and a carriage belt 108 is used to move the carriage 106 in the main scan direction.

Since the print heads 100 and 101 have like structures, in lieu of a description of both structures being given, only the structure of the print head 100 will be described.

Figure 2A:
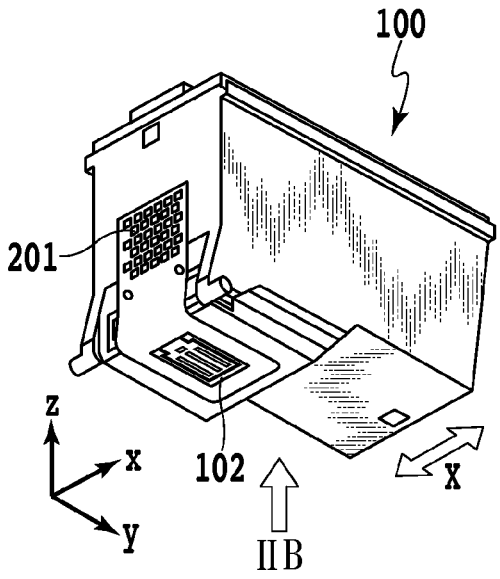
FIG. 2A is a perspective view of the print head in FIG. 1A.
Figure 2B:
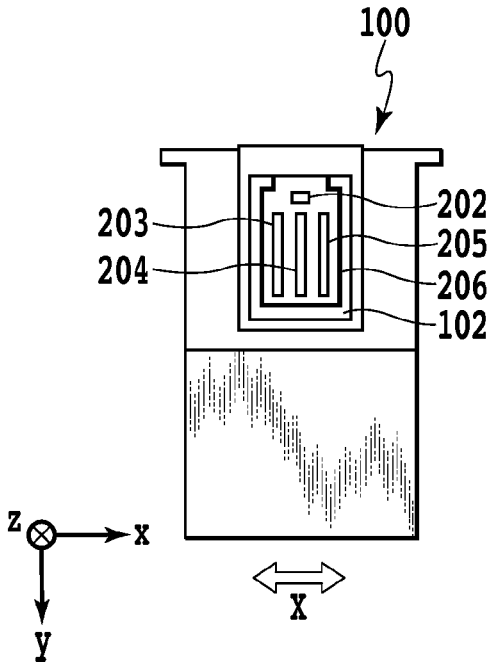
FIG. 2B is a view taken in a direction indicated by the arrow IIB in FIG. 2A.
Figure 2C:
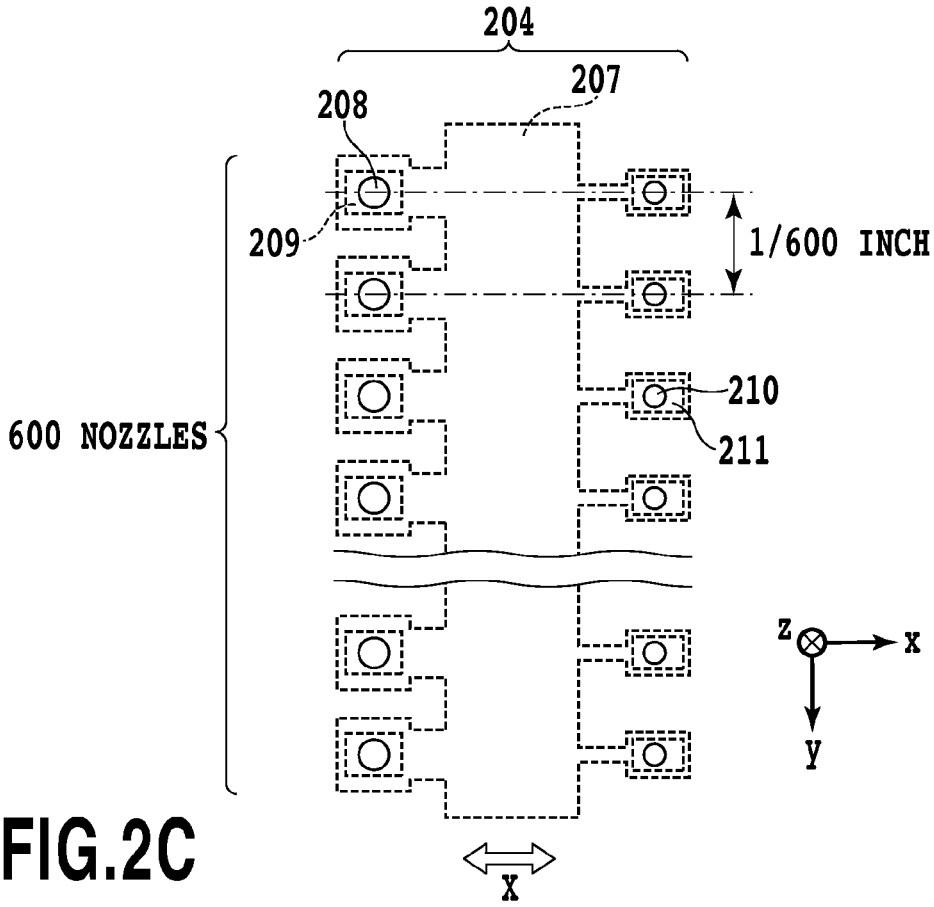
FIG. 2C is an enlarged diagram illustrating an area around ejection ports of the print head in FIG. 1A.

FIG. 2A is a perspective view of the print head 100, FIG. 2B is a bottom view of the print head 100, taken in the direction indicated by an arrow IIB, and FIG. 2C is an enlarged diagram of an area around the ejection ports of the print head 100.

A contact pad 201 receives a print signal from a main body of the printing apparatus and a required driving voltage, and transmits the signal and the voltage to a head chip 102, on which a diode sensor 202 is located that is used to detect the temperature of the print head 100. Instead of the diode sensor 202, however, a variety of other print head temperature detectors including a thin-film metal sensor can be employed.

An ejection port array 203 is used for ejecting the black ink, an ejection port array 204 is used for ejecting the light cyan ink, and an ejection port array 205 is used for ejecting the light magenta ink. These ejection port arrays have the same structure, and only the inks ejected are different. A sub-heater 206 for heating the ink has a resistance of 100Ω, and is mounted around the ejection port arrays. Whether the head chip 102 is to be heated, i.e., either the heating or the heat releasing of the head chip 102, is selected by applying, or by not applying a voltage of 20 V to the sub-heater 206 (to turn the sub-heater 206 on or off), and the temperature of ink in the print head 100 can be controlled.

Since the same structure is employed for the ejection port arrays 203, 204 and 205, in lieu of proving a description for all three of them, only the structure of the ejection port array 204 for black ink will now be described.

FIG. 2C is an enlarged diagram showing the ejection port array 204. On one side of an ink chamber 207 to which black ink is supplied, a plurality of ejection ports 208 are formed for ejecting 5 pl of ink, and on the other side of the ink chamber 207, a plurality of ejection ports 210 are formed for ejecting 2 pl of ink. A heater 209 having a resistance of 500Ω is arranged immediately below the ejection port 208 and generate the thermal energy required to eject 5 pl of ink. A heaters 211 having a resistance of 700Ω is arranged immediately below the ejection port 210 and generate the thermal energy required to eject 2 pl of ink. The heaters 209 and 211 heat ink by applying a voltage of 20 V to form bubbles in the ink, and the energy produced by the bubbles is employed to eject ink through the corresponding ejection ports 208 and 209. In the following description, the ejection port 208 and the heater 209 are collectively referred to as a "nozzle for ejecting 5 pl of ink", while the ejection port 210 and the heater 211 are collectively referred to as a "nozzle for ejecting 2 pl of ink".

In this embodiment, 600 openings each are formed as the ejection ports 208 and 210, and are arranged at 1/600 inch intervals so that the printed pixel density in the sub-scan direction is 600 dpi. Furthermore, in order for ink to be stably ejected, the drive frequency (the ink ejection frequency) employed for the heaters 209 and 211 is 24 kHz. Further, when the printed pixel density in the sub-scan direction is 1200 dpi, the speed (the scanning speed) at which the carriage 106 (on which print heads 100 and 101 are mounted) moves is 20 inches/second (=24000 (dots/second)/1200 (dots/inch)). Also note that black, light cyan, light magenta, cyan, magenta and yellow inks ejected by the print heads 100 and 101 are characterized in that, relative to temperature, all their ejection properties such as an ejection volume and an ejection speed are the same.

Further, in this embodiment, an ejection speed of 15 m/s is optimal for the ejection of 5 pl and 2 pl of ink, and the recommended temperature of ink at this time is 50° C. 30° C. is the temperature of the ink at which the ejection of ink is still ensured even though the ink ejection volume and the ejection speed are inferior to the optimal values and are inappropriate for printing. When the temperature of ink is lower than 30° C., ink ejection is slowed and image printing quality may be deteriorated. While when the temperature of ink is reduced to about room temperature (about 25° C.), ink might not be ejected because at such a temperature ink becomes very viscous. On the other hand, when the temperature of ink is 80° C. or higher, too great a volume of ink will be ejected, and obtaining an adequate resupply of ink is not possible, which ensures that an ink ejection failure will occur.

Figure 3:
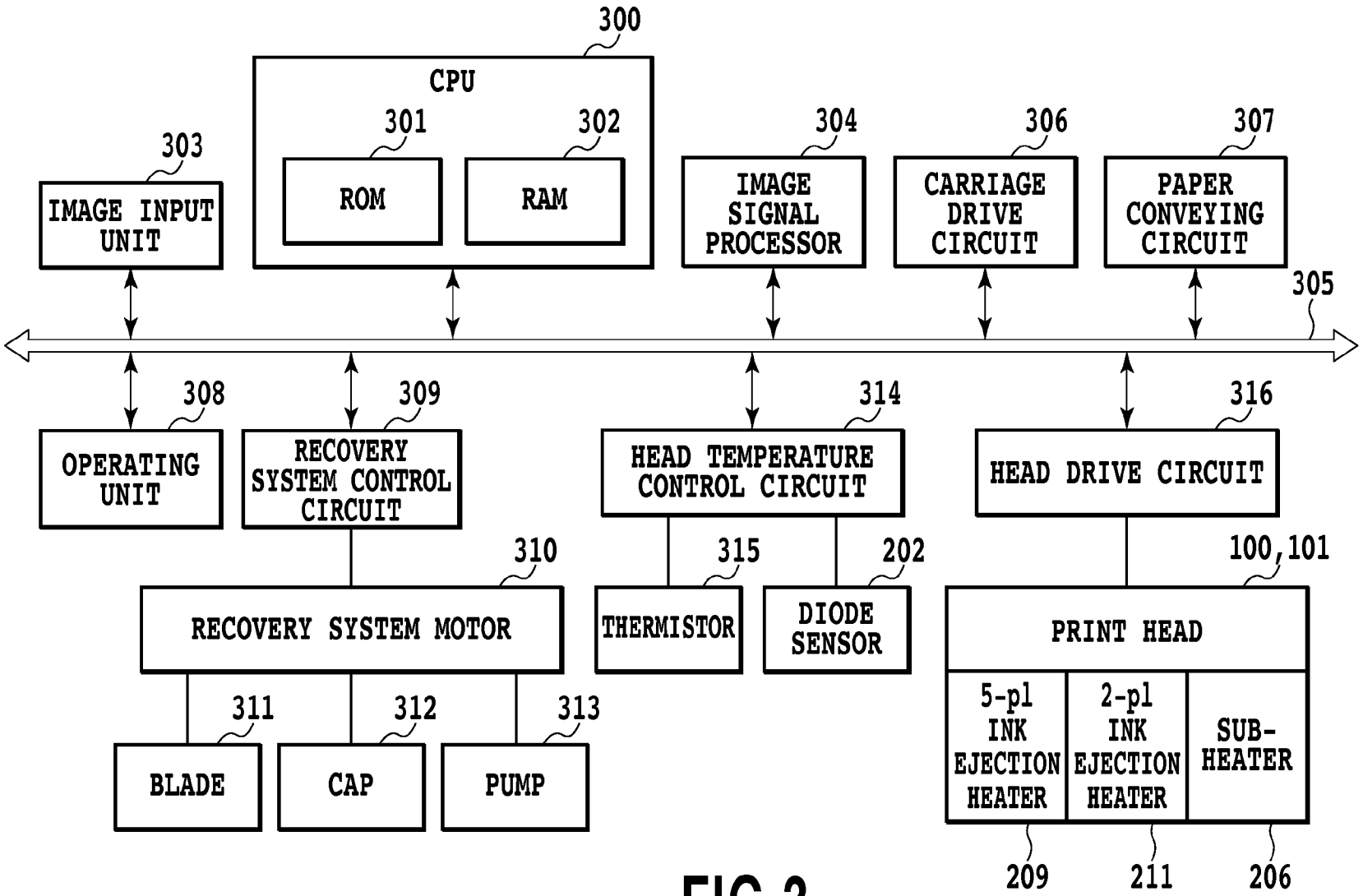
FIG. 3 is a block diagram illustrating an arrangement of a control system for the inkjet printing apparatus in FIG. 1A.

FIG. 3 is a block diagram illustrating an arrangement of a control system of the printing apparatus of this embodiment.

The control system of this embodiment is roughly divided into a software processing section and a hardware processing section. The software processing section includes: an image input unit 303 for receiving an image signal from a host apparatus (a host computer) (not shown); an image signal processor 304 for processing the input image signal; and a central processing unit (CPU) 300, all of which are connected to a main bus line 305. The hardware processing section includes: an operating unit 308, a recovery system control circuit 309, a head temperature control circuit 314, a head driving circuit 316, a carriage driving circuit 306 for controlling the movement of the carriage, and a paper conveying circuit 307 for controlling the conveying of a printing medium P. The CPU 300 includes a ROM (Read Only Memory) 301 and a RAM (Random Access Memory) 302. The CPU 300 provides an appropriate printing condition for the input of data, and drives the heaters 209 for the ejection of 5 pl of ink in the print heads 100 and 101, and the heaters 211 for the ejection of 2 pl of ink in the print heads 100 and 101 so as to perform printing.

A program that executes a timing chart for the recovery of the print head is stored in the RAM 302, and provides, as needed, a print head recovery processing condition, such as a preliminary ejection condition, for the recovery system control circuit 309 and the print heads 100 and 101. A recovery system motor 310 drives a cleaning blade 311 and a cap 312, which are moved relative to the print heads 100 and 101, and a suction pump 313, which generates a negative pressure. A preliminary ejection process, a suction recovery process and a wiping process are to be performed as recovery processes for maintaining a satisfactory ink ejection condition for the print heads 100 and 101. The preliminary ejection process is a process by which ink that does not contribute to image printing is ejected through the ejection ports of the print heads into the cap 312. The suction recovery process is a process during which the print heads are capped with the cap 312, and a negative pressure is introduced into the cap 312 to suck and discharge ink from the ejection ports of the print heads. The wiping process is a process for wiping faces of the print heads by the cleaning blade 311. On the faces, the ejection ports are formed.

The head temperature control circuit 314 determines a driving condition for the sub-heaters 206 of the print heads 100 and 101, based on the output values provided by a thermistor 315, which detects the ambient temperature of the printing apparatus, and a diode sensor 202, which detects the temperatures of the print heads 100 and 101. The head driving circuit 316 drives the sub-heater 206 in accordance with the driving condition. While the head driving circuit 316 also drives the ink ejection heaters 209 and 211 of the print heads 100 and 101 in order to perform either ink ejection for printing and preliminary ink ejection.

An example printing of an image on the printing medium P will now be described (see FIG. 4).

In this example, the size of the printing medium P is A4, and using a one-path scan printing method, an image is printed in a printable area PA on the printing medium P. To print a black image shown in FIG. 4A, two print scans are required. The first print scan is a forward print scan, during which the carriage 106 moves forward in the direction indicated by an arrow X1, and at the same time, black ink is ejected from the print head 100. The second print scan is a reverse print scan during which the carriage 106 moves in the reverse direction indicated by an arrow X2, and the print head 100 ejects black ink.

Figure 4A:
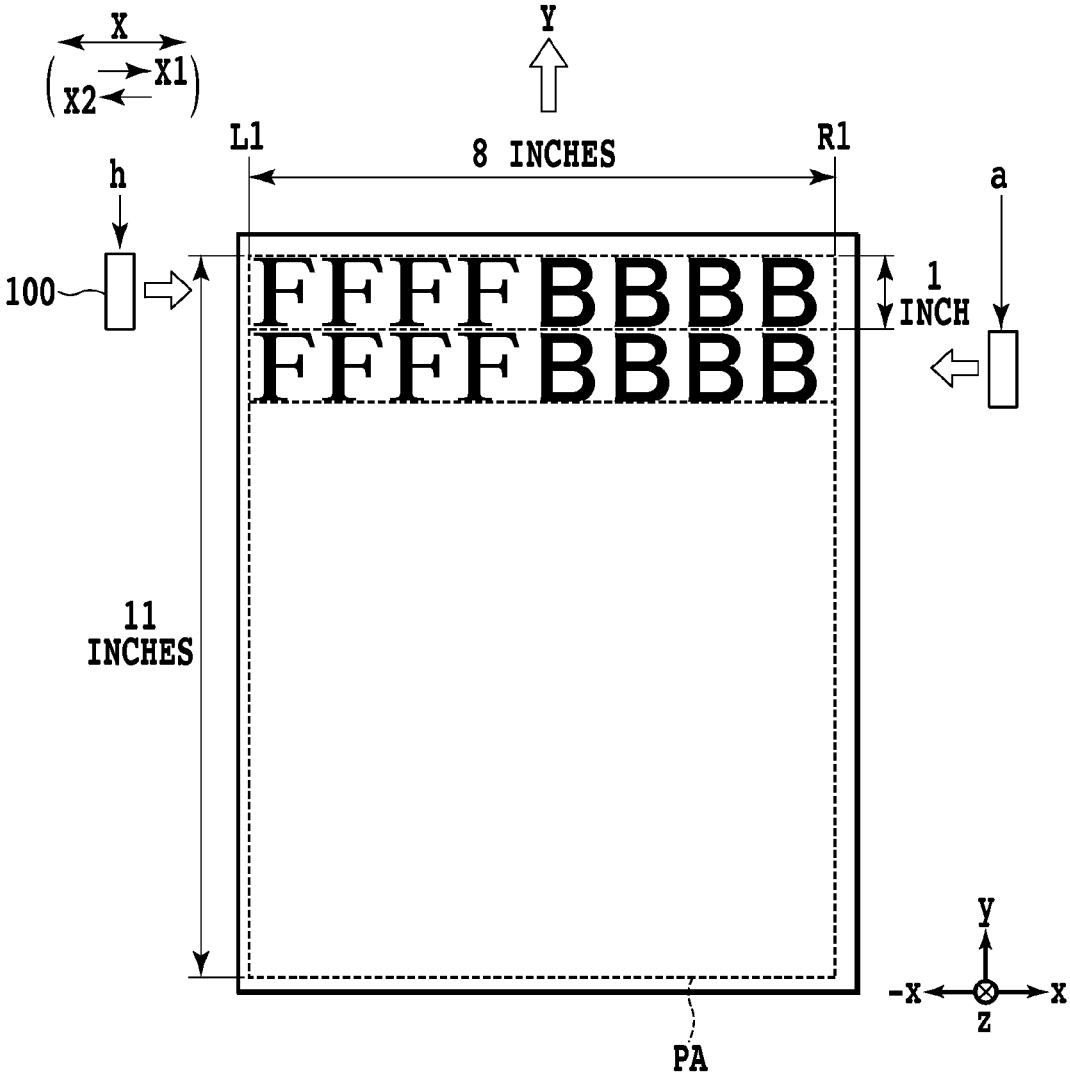
FIG. 4A is a diagram for explaining an example image printed in the first to third embodiments of the present invention.
Figure 4B:
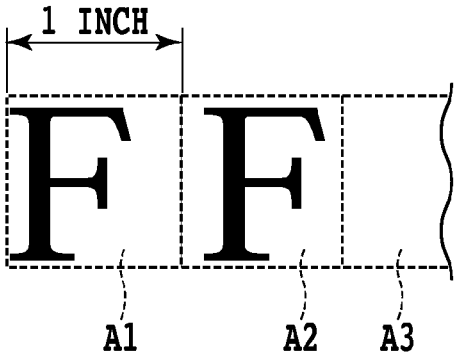
FIG. 4B is an enlarged diagram illustrating a part of the image in FIG. 4A.

FIG. 4B is an enlarged diagram showing the upper left end portion of the printed image in FIG. 4A.

Blocks, such as those labeled A1, A2 and A3, that are enclosed by dotted lines in FIG. 4B are dot count areas, for each of which, the number of the heaters 209 and 211 to be driven during one print scan are counted. The heaters 209 to be driven for 5-pl ink ejection and the heaters 211 to be driven for 2-pl ink ejection are counted separately. That is, the ejection number of 5-pl ink and the ejection number of 2-pl ink are separately counted for each area. As described above, since the ejection ports provide different ejection volumes of ink per scan, the ejection number of ink to be ejected for the unit printing area is counted, based on print data, respectively for the ejection ports that provide different ejection volumes. In this example, the printed image is divided by an interval of one inch, beginning at the end of the printed image, and eight dot count areas A1 to A8 are obtained.

Figure 5:
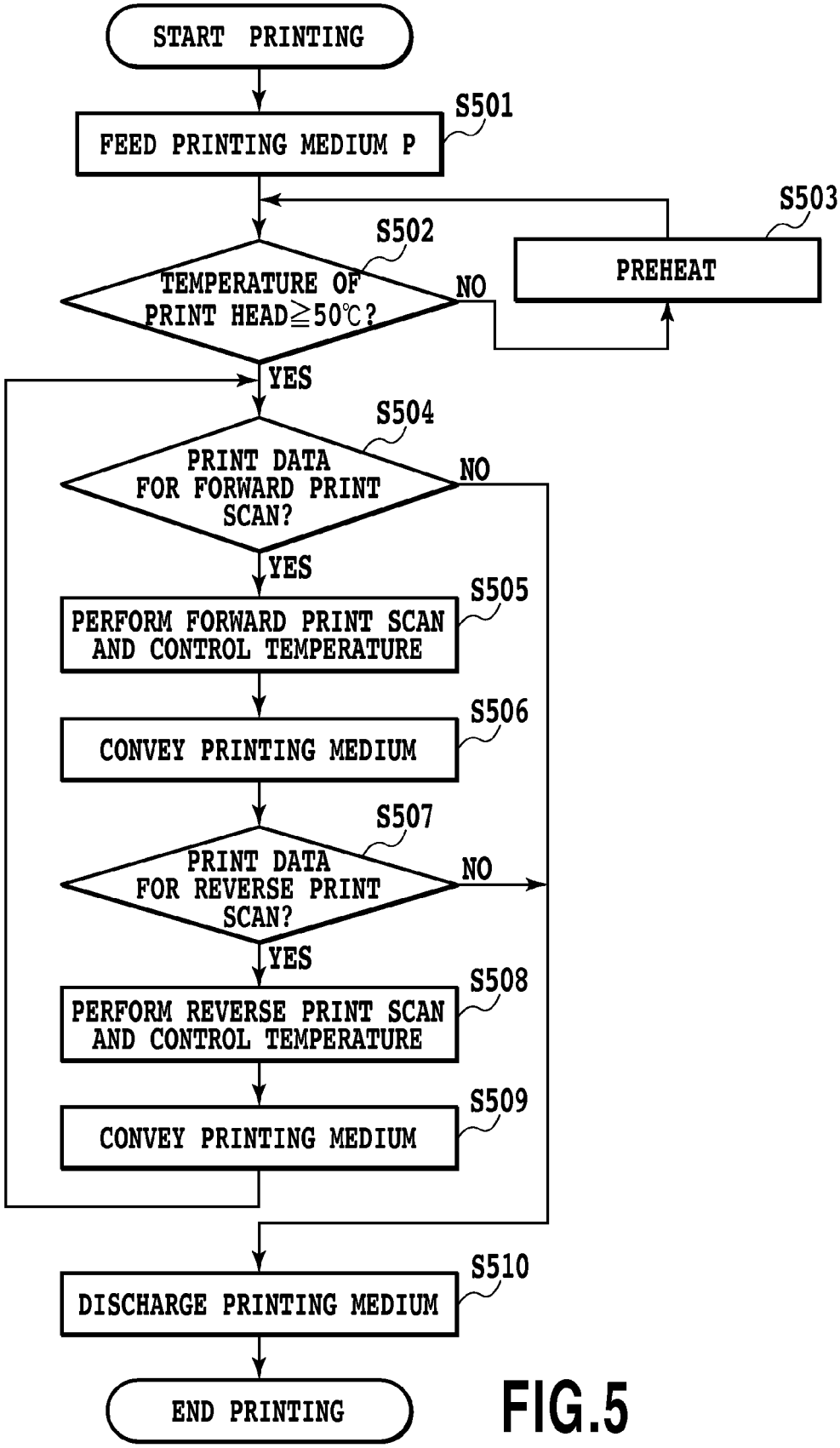
FIG. 5 is a flowchart for explaining a printing operation performed in the first to the third embodiments of the present invention.

FIG. 5 is a flowchart for explaining an image printing operation. In this embodiment, a description will be given for a case wherein 5 pl of black ink is ejected through the ejection ports 208 of the print head 100 to complete the printing of an image. Further, "step S501" is represented by "S501" and the other steps are also represented in the same manner.

When print data is received, the printing operation is started. First, feeding of a printing medium P is begun at S501. The printing medium P is fed by the feed rollers 105, and conveyed to a position where image printing is enabled. When the feeding has been completed, at S502, the output value of the diode sensor 202 is employed to determine whether the temperature of the print head 100 is 50° C. or higher. Since the temperature of the print head in the normal environment is as high as the room temperature (about 25° C.), the printing process shifts from S502 to S503. At S503, preheating is performed prior to printing. During the preheating process, the print head 100 is heated by applying a DC voltage of 20 V to the sub-heater 206 for a period of 10 ms. After the heating has been completed, the printing process returns to S502 to again determine whether the temperature of the print head 100 has reached 50° C. Heating by the sub-heater 206 is repeated until the temperature of the print head 100 reaches 50° C.

When the temperature of the print head 100 has reached 50° C., the printing process advances to S504 to determine whether there is data (print data) to be printed using the forward scan. Since there is print data the first time, the printing process advances to S505, whereat the sub-heater is driven to control the temperature of the print head 100, and the forward print scan is performed based on the print data.

The control provided for the temperature of the print head will now be described (see FIG. 6).

Figure 6:
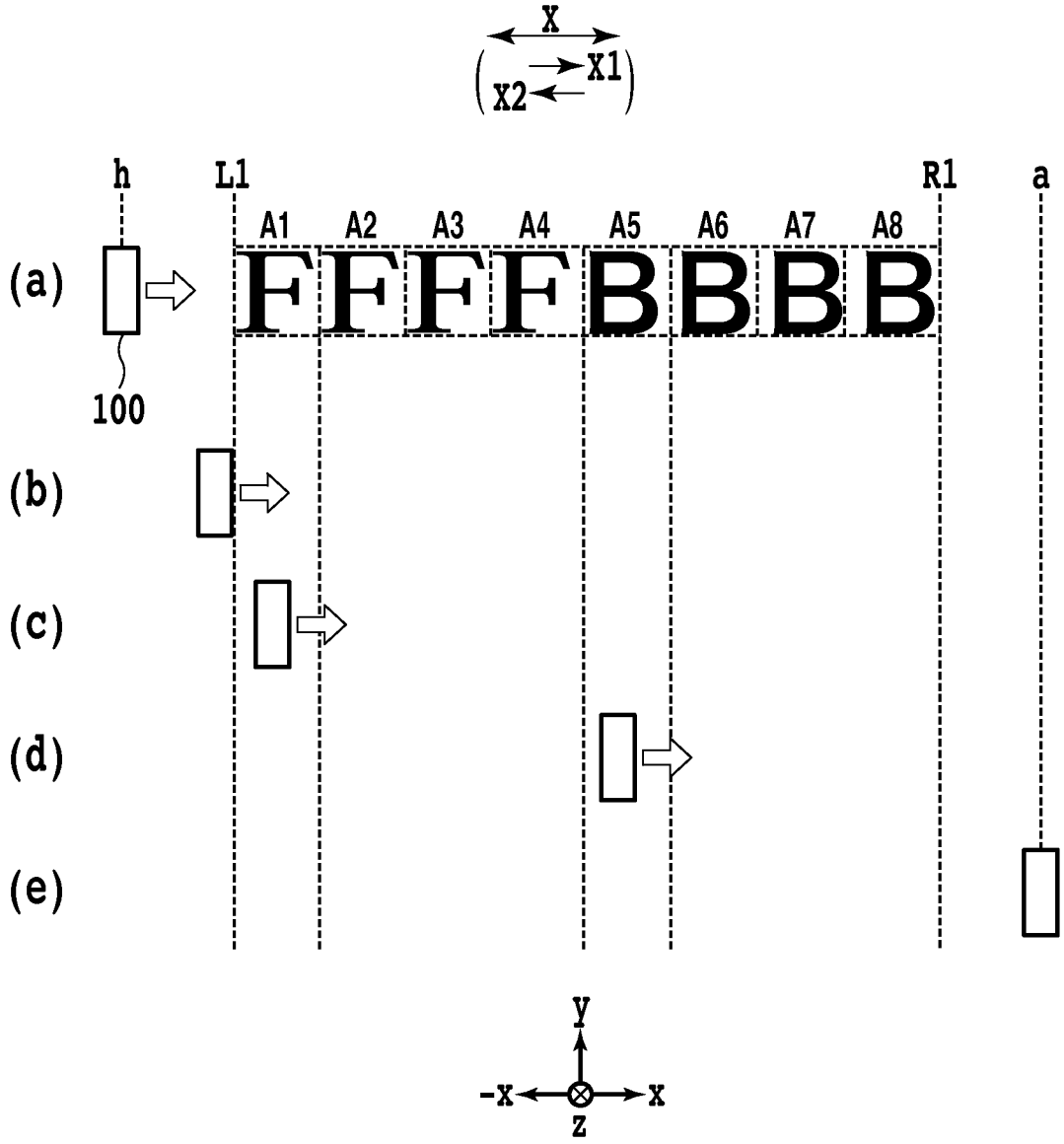
FIG. 6 is a diagram for explaining a moving position of the print head in the first to the third embodiments of the present invention.

The print head 100 is initially located at the home position h, as shown in a part (a) of FIG. 6. For the first forward print scan, the print head 100 is moved to a left end position L1 in the printable area PA, as shown in a part (b) of FIG. 6. When the print head 100 has been moved to the position L1, the temperature (the pre-scan temperature) Tb of the print head 100 is obtained before the start of the print scan. For a single printing operation, the temperature Tb is obtained only this time. This is because during scanning in printing operation, the temperatures of the ink and the print head vary and are no longer the same, because of the affect produced by the exhaustion of heat that accompanies the ejection of ink. The temperature of the print head 100, which was raised to 50° C. at S502, is lowered until the print head 100 is moved to the position L1. In this embodiment, the obtained temperature Tb becomes 49.5° C.

When the temperature Tb has been obtained, the forward print scan is begun. First, an image for the dot count area A1 is printed while controlling the temperature of the print head by using the sub-heater 206, as shown in a part (c) of FIG. 6. The drive duty for the sub-heater 206 at this time is selected from a drive duty table in FIG. 7, in accordance with the temperature Tb and the ejection number D (A1) of 5-pl ink ejected into the dot count area A1. The ejection number D (A1) corresponds to the number of dots to be formed in the dot count area A1 using 5-pl ink droplets. In this embodiment, since the temperature Tb is 49.5° C., when the ejection number D (A1) is 288,000, a drive duty of 40% is selected for the sub-heater 206. This drive duty corresponds to the period for driving the sub-heater 206 per unit time, i.e., the heat value generated by the sub-heater 206 per unit time. For example, when a drive duty is 100%, the sub-heater 206 would be continuously driven, and when a drive duty is 0%, the sub-heater 206 would not be driven.

Figure 8:
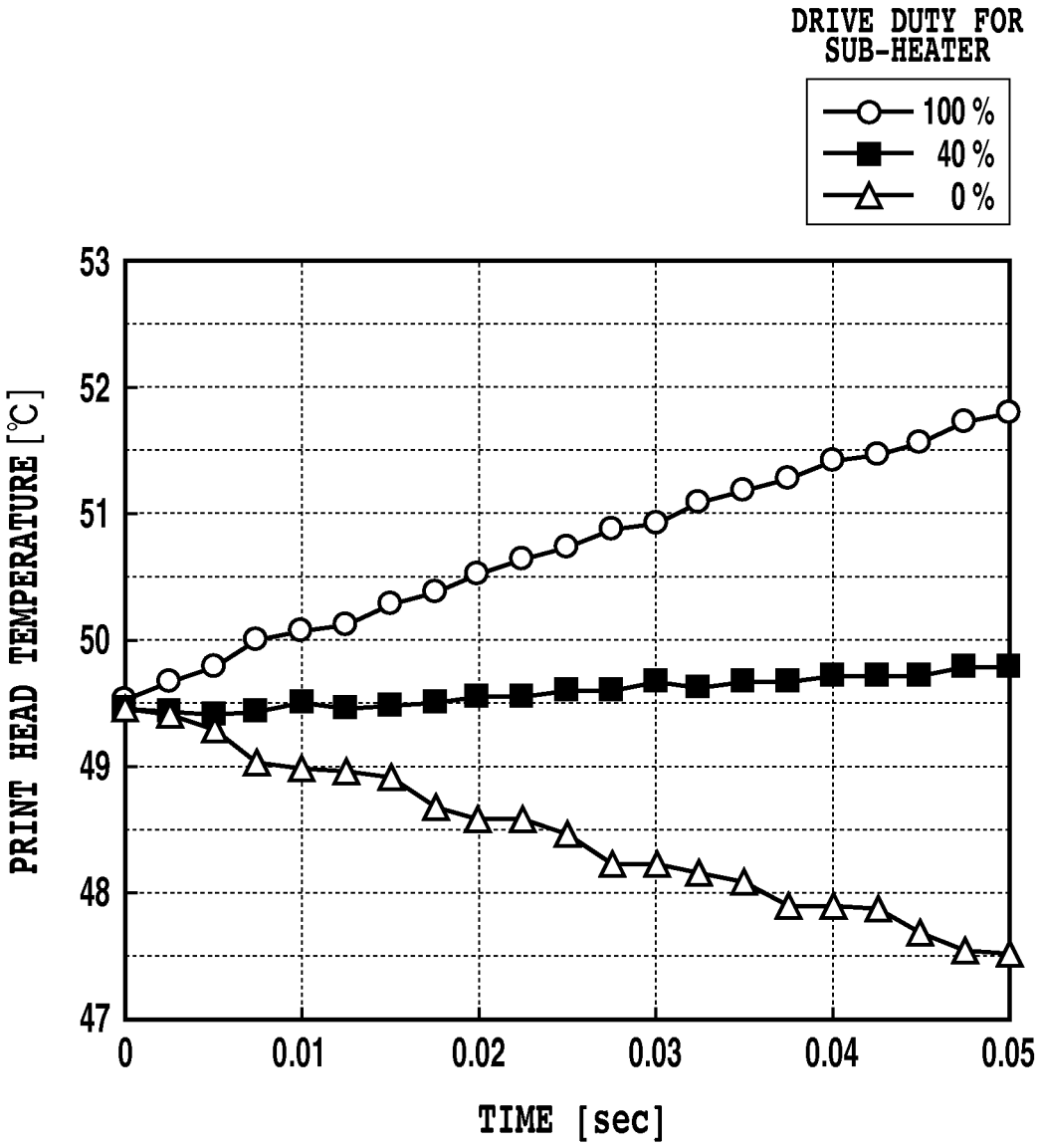
FIG. 8 is a graph for explaining an example shifting of the temperature of the print head in the first embodiment of the present invention.

FIG. 8 is a graph showing the changes in the temperature of the print head during the scanning of the area A1. A period (scanning period) required for scanning the area A1 is 0.05 seconds (=1 (inch)/20 (inch/second)). Solid black squares in the graph indicate the temperature when the sub-heater 206 was driven at the drive duty of 40%. It is apparent that, at the drive duty of 40%, the temperature of the print head 100 could be held near 50° C., unlike at the drive duty of 100% indicated by white circles, and the drive duty of 0% indicated by white triangles. As a result, the ejection volume of ink was stable and a high quality image could be printed.

When the dot count area A1 has been printed, images for the dot count areas A2, A3 and A4 are also printed while controlling the temperature of the print head by using the sub-heater 206. In this embodiment, since the ejection number D (A2), D (A3) and D (A4) of 5-pl ink to be ejected into the dot count areas A2, A3 and A4 are also 288,000, 40% is selected as the drive duty for the sub-heater 206.

Likewise, the sequential dot count area A5 is scanned while adjusting the temperature of the print head using the sub-heater 206. In this embodiment, since the ejection number D (A5) of 5-pl ink to be ejected into the dot count area A5 is 576,000, 50% is selected as the drive duty for the sub-heater 206.

Figure 9:
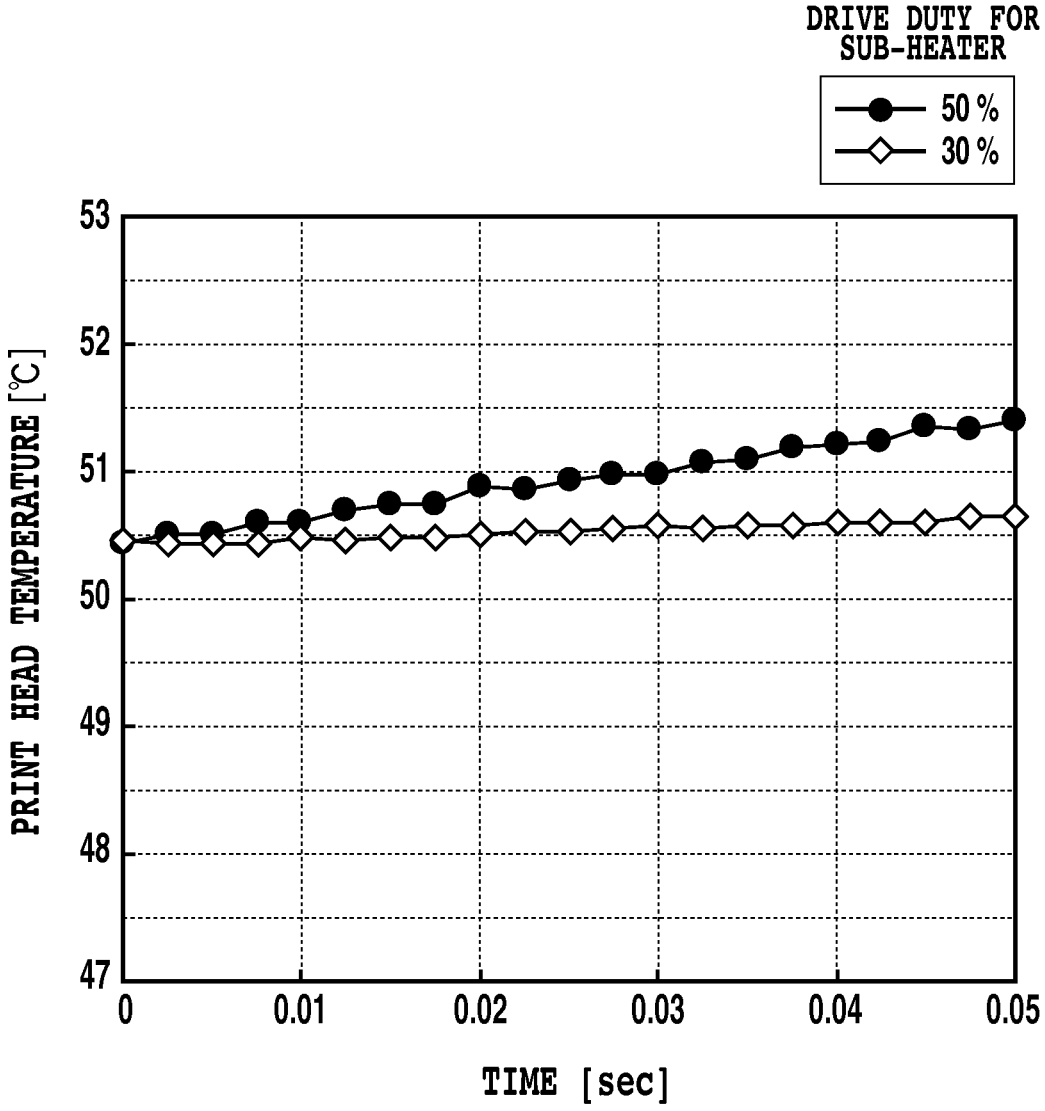
FIG. 9 is a graph for explaining another example shifting of the temperature of the print head in the first embodiment of the present invention.
Figure 10A:
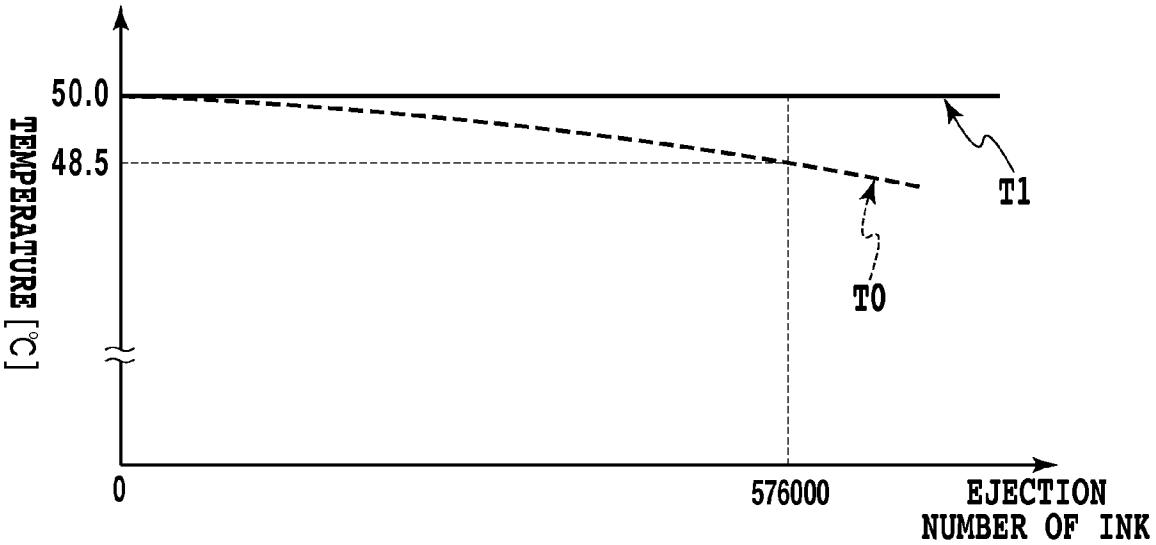
FIGS. 10A and 10B are graphs for explaining a relationship between the ejection number of ink and the temperature of the print head, according to the first embodiment of the present invention.
Figure 10B:
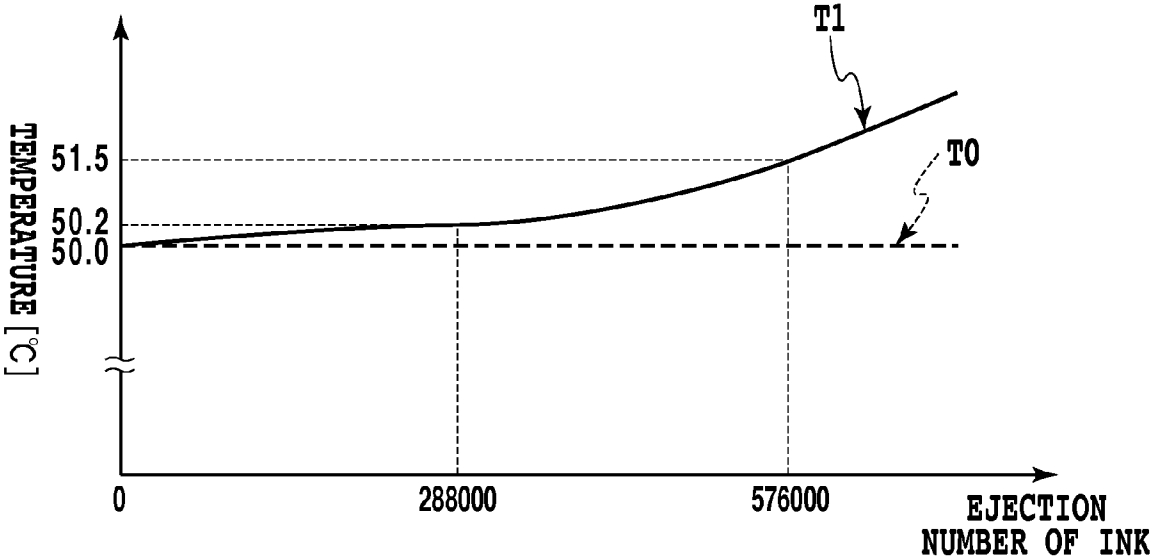

FIG. 9 is a graph showing the change in the temperature of the print head during the scanning of the dot count area A5. Solid black circles used in the graph indicate the temperature when the sub-heater 206 was driven at the drive duty of 50%, and white rhombuses indicate the temperature at the drive duty of 30%. In FIG. 9, at the completion of the scanning of the dot count area A4 (0 second in FIG. 9), the temperature of the print head was 50.5° C. Then, when the temperature change for the print head in FIG. 9 is referred to, it appears that the drive duty of 30% was more effective than the one of 50% in maintaining the temperature of the print head near 50° C. However, as described above, since the heat exhausting effects around the ejection ports are increased in consonance with the increase of the ejection number of ink, a difference occurs between the temperature of the print head detected by the diode sensor 202, and the temperature of the ink around the ejection ports. For example, when, as shown in FIG. 10A, the temperature T1 of the print head detected by the diode sensor 202 was adjusted so as to be maintained at 50° C., the temperature T0 of the ink around the ejection ports was lowered. From this viewpoint, in order to maintain the constant temperature T0 for the ink around the ejection ports, a control unit raises a target temperature of the print head in accordance with the increase of the ejection number of ink. As a result, a temperature T1 of the print head detected by the diode sensor 202 rose as shown in FIG. 10B. Therefore, in this embodiment, the drive duty of 50% is employed. The target temperature of the print head is controlled by the head temperature control circuit (control unit) 314. Alternatively, the target temperature of the print head can be controlled by the CPU 300.

After the printing of the dot count area A5 had been completed, images for the dot count areas A6, A7 and A8 were printed while adjusting the temperature of the print head using the sub-heater 206. In this embodiment, since the ejection number of 5-pl ink D (A6), D (A7) and D (A8) for the areas A6, A7 and A8 are also 576,000, 50% was selected as the drive duty for the sub-heater 206. Thus, when the scanning of the area A8 had been completed, the print head 100 was moved to a disengaged position a in a part (e) of FIG. 6 to prepare for the following reverse can.

Then when the forward print scan at S505 has been performed, at S506 the printing medium P is conveyed one inch in the sub-scan direction, and at S507, a check is performed to determine whether there is data (print data) to be printed by the reverse print scan. In this embodiment, since there is data to be printed, the printing process advances to S508, and the reverse print scan is initiated while controlling the temperature of the print head by using the sub-heater 206.

In the control process for the temperature of the print head, as well as for the forward print scan, the sub-heater 206 is driven in accordance with the temperature (the pre-scan temperature) Ta of the print head and the ejection number of ink. It should be noted that at this time the temperature Ta is detected by the diode sensor 202 when the print head has moved from the disengaged position a to a right end position R1 for the printable area PA. In this embodiment, the temperature Ta obtained was 50.0° C. Further, since the print data is the same for the forward print scan and the reverse print scan, the ejection number of ink ejected onto the areas A1 to A8 for the reverse print scan are the same as those for the forward print scan. Therefore, the drive duty of 15% for the sub-heater 206 is selected for the areas A8, A7, A6 and A5, and the drive duty of 10% is selected for the areas A4, A3, A2 and A1.

When the reverse print scan at S508 has been completed, at S509 the printing medium P is conveyed one inch in the sub-scan direction, and printing process returns to S504 to determine whether there is data (print data) to be printed by the forward print scan. Since in this instance there are no more print data, the printing process is shifted to S510, where the printing medium P is discharged. Thereafter, the printing operation is terminated.

Figure 11A:
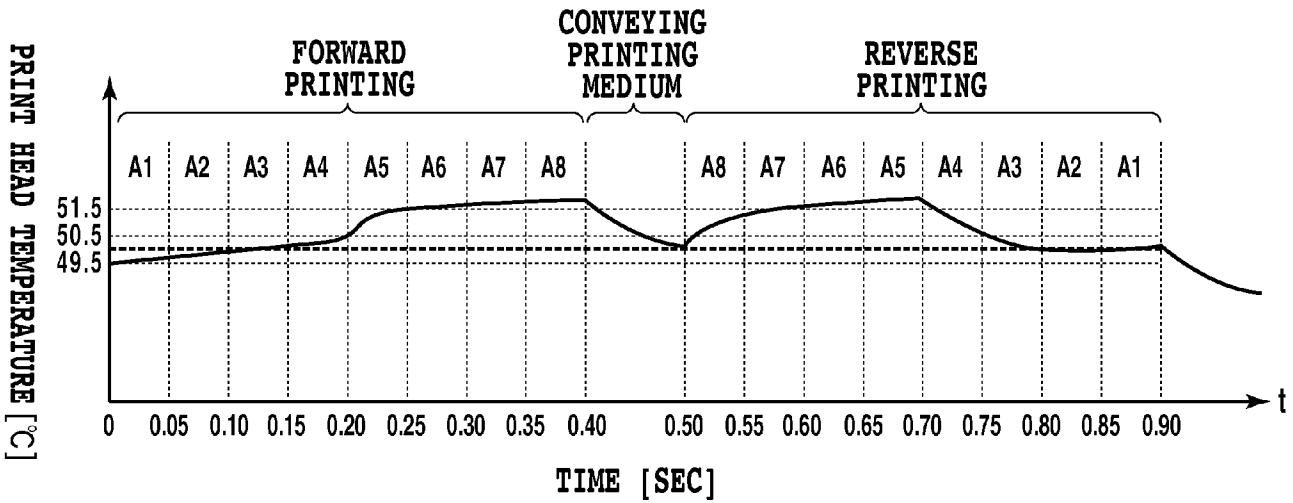
FIG. 11A is a graph for explaining the shift in the temperature of the print head in the first embodiment of the present invention.
Figure 11B:
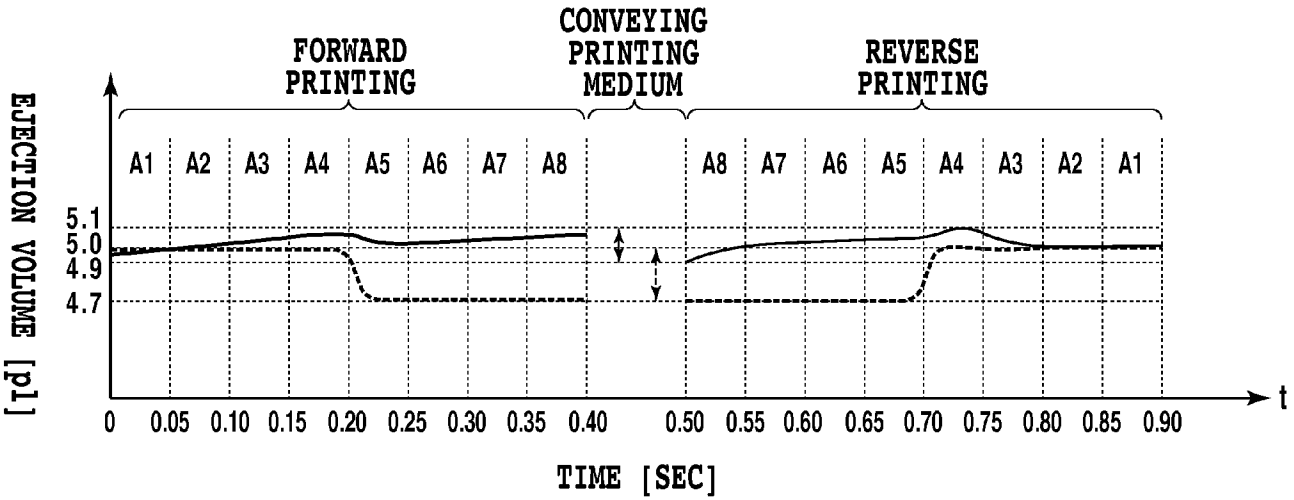
FIG. 11B is a graph for explaining the shift in the ejection volume of ink ejected by the print head in the first embodiment.

In the above described period, from the start of the forward print scan to the end of the reverse print scan, the temperature of the print head is shifted as shown in FIG. 11A, and the ejection volume of ink is shifted as shown in FIG. 11B. The solid lines in FIGS. 11A and 11B indicate the shifts in the temperature and the ejection volume in the embodiment, and the dotted lines indicate shifts in the temperature and in the ejection volume prepared as a comparison example wherein the temperature of the print head is adjusted so always 50° C.

Referring to the temperature shift in FIG. 11A, the temperature of the print head in this embodiment fluctuates more, within a range of 2° C. or greater, than that in the comparison example. However, referring to the ejection volume shift in FIG. 11B, the fluctuation range in this embodiment is 0.2 pl, which is smaller than the 0.3 pl in the comparison example. This is because, as previously described, the temperature control was provided to compensate for a difference between two temperatures that occurs at a high printing duty, i.e., a difference between the temperature of the print head and the temperature of the ink around the ink ejection port.

As described above, according to this embodiment, even at a high printing duty, the fluctuation of the ejection volume of ink and the occurrence of an uneven density can be prevented, and a high quality image can be printed.

Second Embodiment

In the first embodiment, printing is performed only by ejecting 5-pl ink droplets. In this embodiment, either a print mode (hereinafter also referred to as a "first print mode") for ejecting only 5-pl ink droplets to print images, or a print mode (hereinafter also referred to as a "second print mode") for ejecting only 2-pl ink droplets to print images is selected. In the first print mode, only ejection ports 208 for ejecting 5-pl ink are employed, and in the second print mode, only ejection ports 210 for ejecting 2-pl ink are employed. Images printed in this embodiment are the same as those in FIGS. 4A and 4B, previously described for the first embodiment.

Figure 12:
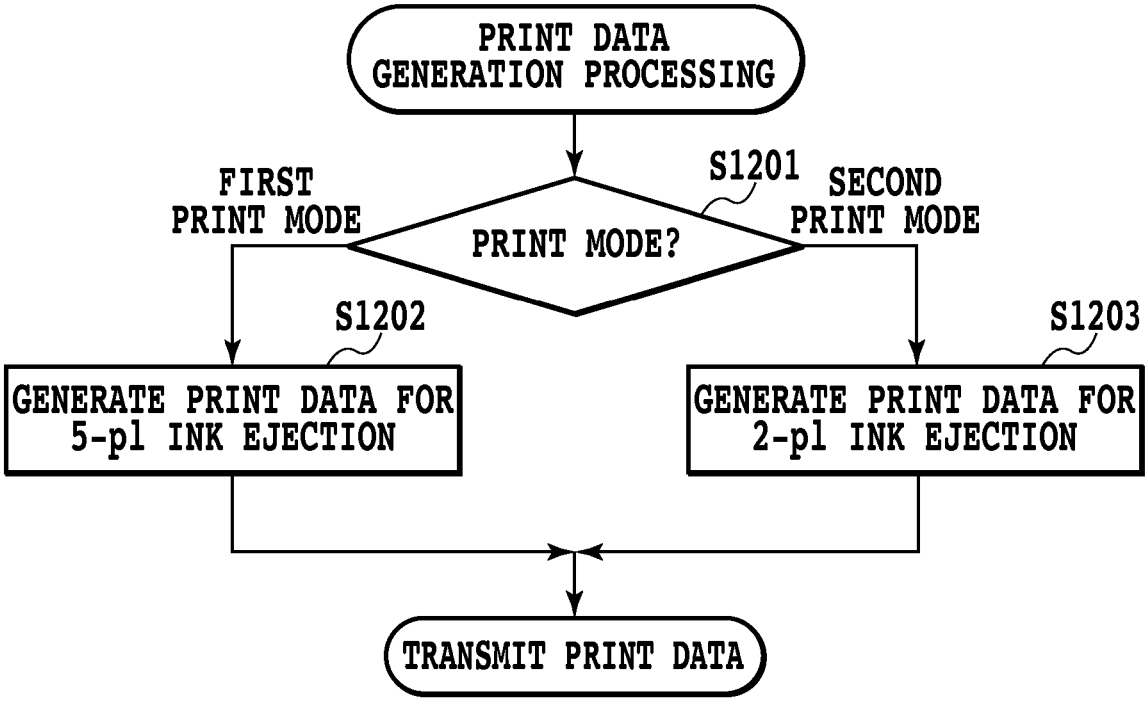
FIG. 12 is a flowchart for explaining a print data preparation processing performed in the second embodiment of the present invention.

FIG. 12 is a flowchart for explaining the print data generating process.

When a print data generating instruction is received, at S1201, a check is performed to determine whether the first or the second print mode has been selected. When the first print mode has been selected, the process is shifted to S1202, and the image signal processor 304 generates print data, based on which 5-pl ink droplets are ejected. On the other hand, when the second print mode has been selected, the process is shifted to S1203, and the image signal processor 304 generates print data, based on which 2-pl ink droplets are ejected. The first or the second print mode can be automatically selected in consonance with an image to be printed, or can be arbitrarily selected.

The print data generated by the image signal processor 304 is transmitted to controllers, such as the carriage driving circuit 306, the paper conveying circuit 307 and the head driving circuit 316, to perform the printing operation. As well as in the first embodiment, the printing operation is performed based on the print data, following the flowchart in FIG. 5. When the first print mode is selected, the same print data as in the first embodiment is generated, and accordingly, the printing operation is the same as that for the first embodiment.

Therefore, only the processing performed when the second print mode is selected will be described.

When print data for ejecting 2 pl of ink is received, the printing operation is started. First, a printing medium P is fed at S501 in FIG. 5, and the processes at S502 and S503 are repeated to perform the preheating until the temperature of the print head 100 reaches 50° C. When the temperature of the print head has reached 50° C., at S504 a check is performed to determine whether there is print data for performing the forward print scan. Since in this case there is print data, the printing process advances to S505, and the forward print is performed based on the print data, while the temperature of the print head is controlled. A carriage is moved in the same manner as explained in the first embodiment while referring to FIG. 6. However, the drive duty table for the sub-heater 206 is set as shown in FIG. 13, which differs from that for the first embodiment.

In the forward print scan, first, at the time shown in a part (b) of FIG. 6, the temperature Tb (=49.5° C.) of the print head is obtained, and as shown in a part (c) of FIG. 6, printing is performed in the area A1 while controlling the temperature of the print head using the sub-heater 206. At this time, the drive duty for the sub-heater 206 for controlling the temperature of the print head is selected from the drive duty table in FIG. 13 in accordance with the temperature Tb and the ejection number of 2-pl ink to be ejected into the area A1. In this embodiment, since the ejection number d (A1) for the area A1 is 288,000, and the temperature Tb is 49.5° C., the drive duty of 50% is selected.

Further, the ejection numbers d (A2), d (A3) and d (A4) for the areas A2, A3 and A4 are 288,000, and the ejection numbers d (A5), d (A6), d (A7) and d (A8) for the areas A5, A6, A7 and A8 are 576,000. Therefore, the drive duty of 50% is selected for the areas A1 to A4, and the drive duty of 40% is selected for the areas A5 to A8.

When the forward print scan has been completed, at S506 the printing medium P is conveyed one inch in the sub-scan direction, and at S507 a check is performed to determine whether there is still print data for performing the reverse print scan. In this embodiment, since there is more print data, the printing process advances to S508, where the reverse print scan is performed while adjusting the temperature of the print head. Since the print data for the reverse print scan is the same as that for the forward print scan, the ejection numbers of 2-pl ink for the individual areas are not changed. Further, when the print head is moved to the right end position R1 of the printable area PA, 49.0° C. is obtained as the temperature Tb of the print head. Therefore, the drive duty of 40% is selected for the areas from A5 to A8, and the drive duty of 50% is selected for the areas from A1 to A4.

After the reverse print scan has been performed, at S509 the printing medium P is conveyed one inch in the sub-scan direction, and the printing process returns to S504 to determine whether there is print data for performing the forward print scan. In this instance, since there are no print data, the printing process is shifted to S510 and the printing medium P is discharged. The printing process is thereafter terminated.

Figure 14A:
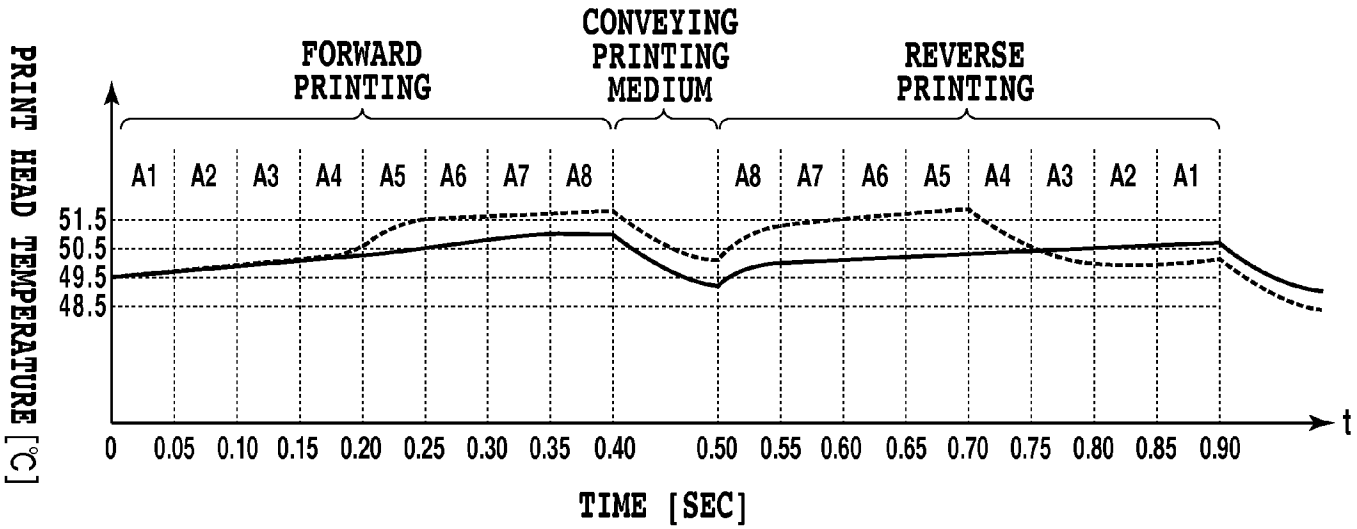
FIG. 14A is a graph for explaining the shift in the temperature of the print head for the second embodiment of the present invention.
Figure 14B:
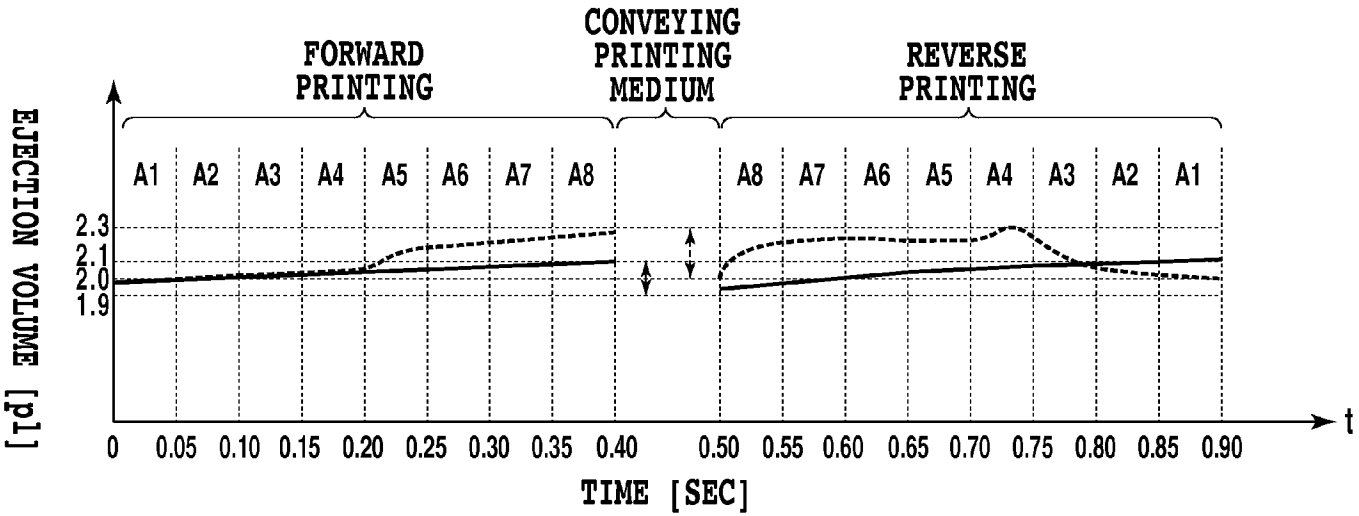
FIG. 14B is a graph for explaining the shift in the ejection volume of ink ejected by the print head of the second embodiment.
Figure 15:
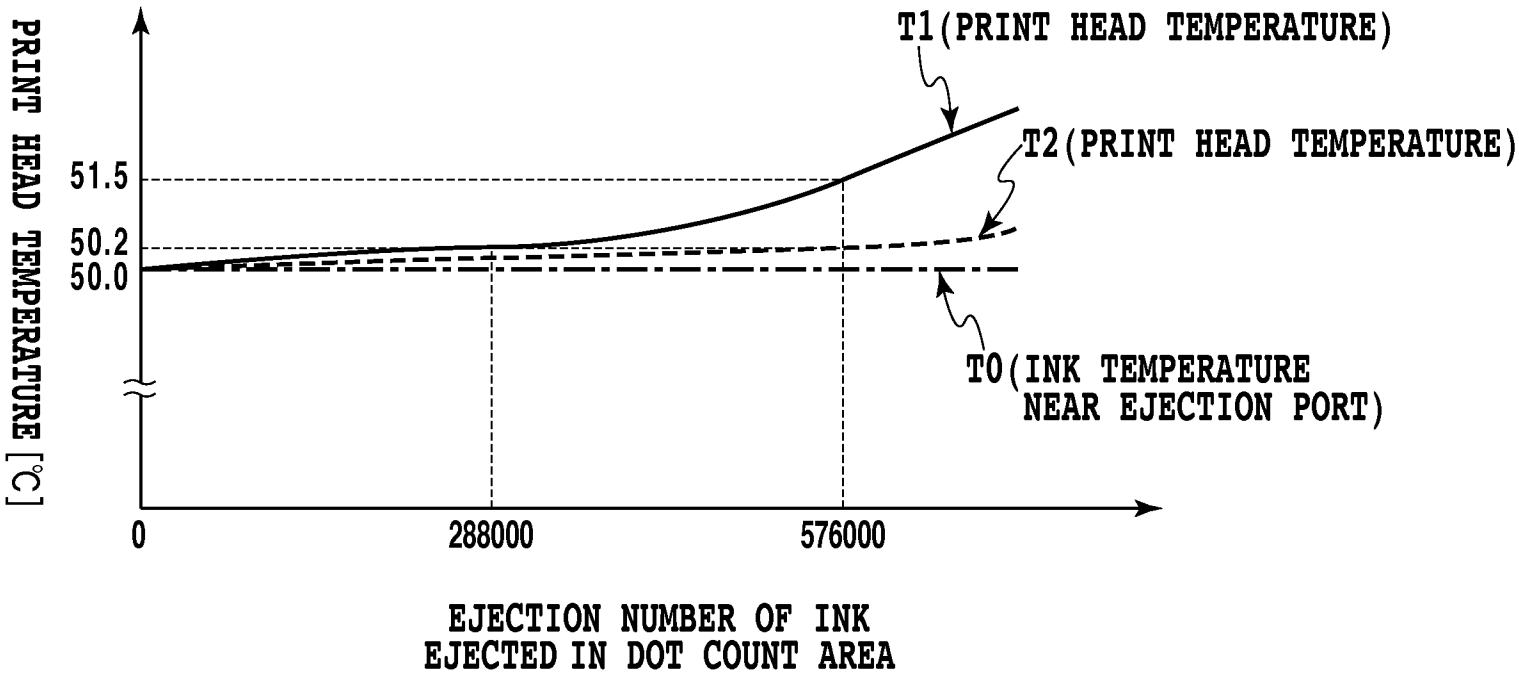
FIG. 15 is a graph for explaining a relationship between the ejection number of ink and the temperature of the print head for the second embodiment of the present invention.

During a period from the start of the forward print scan to the end of the reverse print scan, the temperature of the print head is shifted as shown in FIG. 14A, and the ejection volume of ink is shifted as shown in FIG. 14B. The solid lines in FIGS. 14A and 14B indicate the shifts in the temperature and the ejection volume in this embodiment, and dotted lines indicate the shifts in the temperature and the ejection volume as a comparison example that employs the table in FIG. 7 provided for the first embodiment instead of the table in FIG. 13. In FIG. 14A, the temperature shift for the print head of this embodiment has a smaller fluctuation than that in the comparison example. In FIG. 14B, the ejection volume in the comparison example fluctuates in a range of 0.3 pl, while the fluctuation of the ejection volume of this embodiment is reduced to 0.2 pl. When only 2-pl ink droplets are employed for printing, heat exhausting effects are smaller than when 5-pl ink droplets are employed. Therefore, it is effective to reduce the temperature control range more than when 5-pl ink droplets are employed. T2 in FIG. 15 represents the temperature of the print head detected by the diode sensor 202 in the temperature control process of this embodiment. It is effective, for maintaining a constant temperature T0 of ink around the ejection port, to control the temperature of the print head so that the temperature T2 is adjusted lower than the temperature T1 (see FIG. 10B) in the first embodiment.

As described above, in this embodiment, when small ejection ports 210 are employed to print the image, the temperature of the print head should be lower than when large ejection ports 208 are employed for printing. With this arrangement, the fluctuation of the ejection volume of ink can be prevented regardless of the sizes of the ejection ports, and an uneven printing density will not occur, so that a high-quality image can be printed.

Third Embodiment

In the second embodiment, either the first print mode, for printing an image by ejecting ink of 5 pl, or the second print mode, for printing an image by ejecting ink of 2 pl, has been selected. In this embodiment, another print mode (hereinafter also referred to as a "third print mode") for printing an image by ejecting ink of both 5 pl and 2 pl can also be selected. Images printed in this embodiment are the same as those in FIGS. 4A and 4B in the first and second embodiments.

Figure 16:
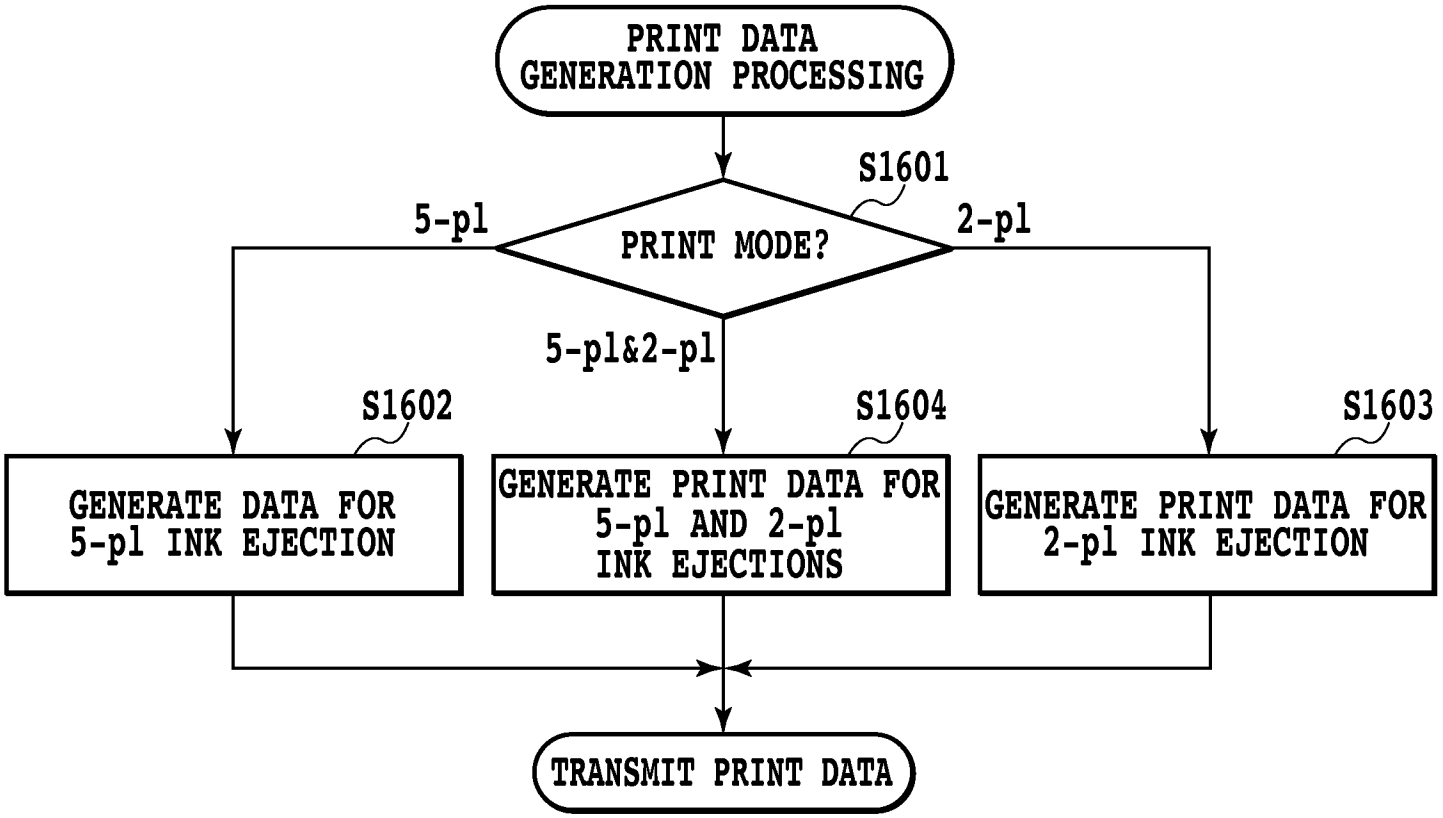
FIG. 16 is a flowchart for explaining a print data preparation processing performed in the third embodiment of the present invention.

FIG. 16 is a flowchart for explaining the print data generation processing.

When a print data generation instruction is received, at S1601 a check is performed to determine whether the first, the second or the third print mode is selected. When the first print mode is selected, the process is shifted to S1602, and the image signal processor 304 generates print data for ejecting 5-pl ink. When the second print mode is selected, the process is shifted to S1603, and the image signal processor 304 generates print data for ejecting 2-pl ink. When the third print mode is selected, the process is shifted to S1604, and the image signal processor 304 generates print data for ejecting ink of 5 pl and 2 pl. The first, second and third print modes can be automatically selected in accordance with an image to be printed, or be arbitrarily selected.

The print data generated is transmitted to controllers, such as the carriage driving circuit 306, the paper conveying circuit 307 and the head driving circuit 316, to perform the printing operation. As well as in the first and second embodiments, the printing operation is performed based on this print data, in accordance with the flowchart in FIG. 5. Since the same print data as in the first embodiment is generated when the first print mode is selected, the printing operation is performed in the same manner as in the first embodiment. Further, since the same print data as in the second embodiment is generated when the second print mode is selected, the printing operation is performed in the same manner as in the second embodiment.

Therefore, only the processing performed when the third print mode is selected will be described.

When print data for ejecting ink of 5 pl and 2 pl is received, the printing operation is started. First, the printing medium P is conveyed at S501 in FIG. 5, the preheating is performed by repeating the processes at S502 and S503 until the temperature of the print head 100 reaches 50° C. When the temperature of the print head has reached 50° C., at S504 a check is performed to determine whether there is print data for performing the forward print scan. In this embodiment, since there is print data, the process advances to S505, and the forward print scan is performed based on the print data, while the temperature of the print head is adjusted. The carriage is moved in the same manner as in the first embodiment, explained while referring to FIG. 6. However, the drive duty for the sub-heater 206 is selected using a table shown in FIG. 17, while employing a different method from that used for the first embodiment.

During the forward print scan, first, the temperature Tb (=49.5° C.) of the print head is obtained at the time shown in a part (b) of FIG. 6, and printing for the area A1 is performed while controlling the temperature of the print head using the sub-heater 206, as shown in a part (c) of FIG. 6. At this time, the drive duty table in FIG. 17 is employed to select the drive duty for the sub-heater 206 that controls the temperature of the print head. That is, first, an ejection parameter for the area A is calculated using the ejection number D (A1) for 5-pl ink to be ejected into the area A1 and the ejection number d (A1) for 2-pl ink to be ejected into the area A1. Then, based on the ejection parameter value and the temperature Tb, the drive duty for the area A1 is selected from the table in FIG. 17.

The ejection parameter value of the area A1 is calculated by a equation {D (A1)}+{d (A1)}×{C (A1)}, wherein C (A1) denotes a temperature coefficient for the area A1. In the following description, the temperature coefficients designated for the individual areas A1 and A2, . . . are also generally called a "temperature coefficient C".

Figure 18:
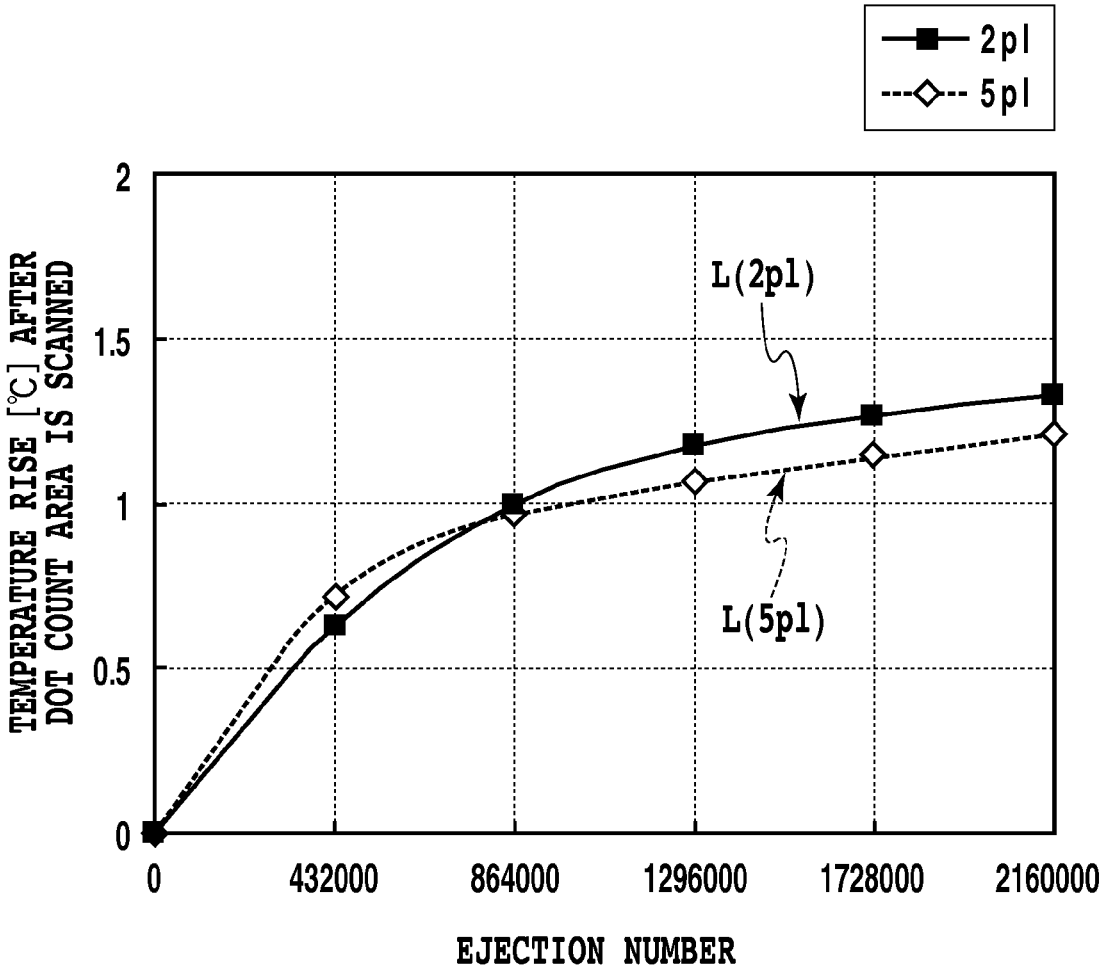
FIG. 18 is a graph for explaining a relationship between the ejection number of ink and the temperature of the print head in the third embodiment of the present invention.

The temperature coefficient C is a ratio of the increase in a temperature at the print head when 2-pl ink droplets are ejected, relative to when 5-pl ink droplets equivalent in number are ejected. That is, the temperature coefficient C represents a ratio of a temperature rise which occurs during 2-pl ink ejection, to a temperature rise that occurs during 5-1 ink ejection. A curve L (2 pl) in FIG. 18 indicates a relationship between the ejection number of 2-pl ink which are ejected into a dot count area when the temperature of the print head is 50° C., and a rise in the temperature at the print head after the dot count area has been scanned. A curve L (5 pl) in FIG. 18 indicates a relationship between the ejection number of 5-pl ink which are ejected to a dot count area when the temperature of the print head is 50° C., and the rise in temperature at the print head after the dot count area has been scanned. These curves L (2 pl) and L (5 pl) show the temperature changes for the print head when temperature control using the sub-heater is not performed.

When ink droplets of 5 pl are ejected, larger ejection energy is required than when 2 pl are ejected. Furthermore, when the ejection number is low, heat exhausting effects are reduced in consonance with the ink ejection. Therefore, as apparent from FIG. 18, when the ejection number is reduced, the accumulated heat is increased for ejection of 5-pl ink than for ejection of 2-pl ink. In addition, when the ejection volume of ink is increased, reduction of accumulated heat is increased, because heat exhausting effects for 5-pl ink ejection is greater than for 2-pl ink ejection. Therefore, in a long run, the amount of accumulated heat for 5-pl ink ejection becomes smaller than that for 2-pl ink ejection. The temperature coefficient C is a ratio employed to convert the temperature increase for the 2-pl ink ejection into the temperature increase for the 5-pl ink ejection. It may be appropriate that the temperature coefficient C be actually employed as a functional expression. However, in this embodiment, the temperature coefficient C is formed into a table as shown in FIG. 19 for simplification of the control process.

For the area A1, the ejection number D (A1) of 5-pl ink is 100,000 and the ejection number d (A1) of 2-pl ink is 200,000. Therefore, temperature coefficient C (A1) of 0.79 is selected from the table in FIG. 19, and the ejection parameter is 258,000 (=100,000+(200,000×0.79)). Further, since the temperature Tb of the print head before the print scan is performed is 49.5° C., the drive duty of 40% for the sub-heater 206 is selected for the area A1 from the table in FIG. 17.

For the areas A2, A3 and A4, the ejection numbers D (A2), D (A3) and D (A4) of 5-pl ink are equal to the ejection number D (A1), and the ejection numbers d (A2), d (A3) and d (A4) of 2-pl ink are equal to the ejection number d (A1). Therefore, the same drive duty of 40% as used for area A1 is selected for the areas A2, A3 and A4.

For the area A5, the ejection number D (A5) of 5-pl ink is 500,000 and the ejection number d (A5) of 2-pl ink is 300,000. Therefore, temperature coefficient C (A5) of 0.85 is selected from the table in FIG. 19, and the ejection parameter is 755,000 (=500,000+(300,000×0.85)). Since the temperature Tb is 49.5° C., the drive duty of 50% for the sub-heater 206 is selected from the table in FIG. 17.

For the areas A6, A7 and A8, the ejection numbers D (A6), D (A7) and D (A8) of 5-pl ink are equal to the ejection number D (A5), and the ejection numbers d (A6), d (A7) and d (A8) of 2-pl ink are equal to the ejection number d (A5). Therefore, the same drive duty of 50% as used for the area A5 is selected for the areas A6, A7 and A8.

As a result, the drive duty of 40% is employed for the areas A1 to A4, and the drive duty of 50% is employed for the areas A5 to A8.

When the forward print scan is completed, at S506 in FIG. 5 the printing medium P is conveyed one inch in the sub-scan direction, and at S507 a check is performed to determine whether there is print data to be printed by the reverse print scan. In this embodiment, since there is such print data, the process advances to S508, and the reverse print scan is performed while controlling the temperature of the print head using the sub-heater 206. Temperature control using the sub-heater 206 is performed in the same manner as in the forward print scan. In this embodiment, the ejection number of 5-pl ink and the ejection number of 2-pl ink are unchanged for the reverse print scan, and when the print head has moved to the right end position R1 of the printable area PA, the obtained temperature Tb is 50.0° C. Therefore, the drive duty of the sub-heater is 15% for the areas A8 to A5, and 10% for the area A4 to A1.

When the reverse print scan is completed, at S509 the printing medium P is conveyed one inch in the sub-scan direction, and the process returns to S504 to determine whether there are print data to be printed by the forward print scan. In this embodiment, since there are no such print data, the process is shifted to S510, and the printing medium P is discharged. The printing operation is thereafter terminated.

The temperature coefficient C selected from the table in FIG. 19 becomes greater in accordance with the increase in the ejection number of ink (count value), and when the ejection number of ink (count value) is equal to or greater than a predetermined value (equal to or greater than 864,001 in this embodiment), the temperature coefficient C is equal to or greater than 1.

Figure 20A:
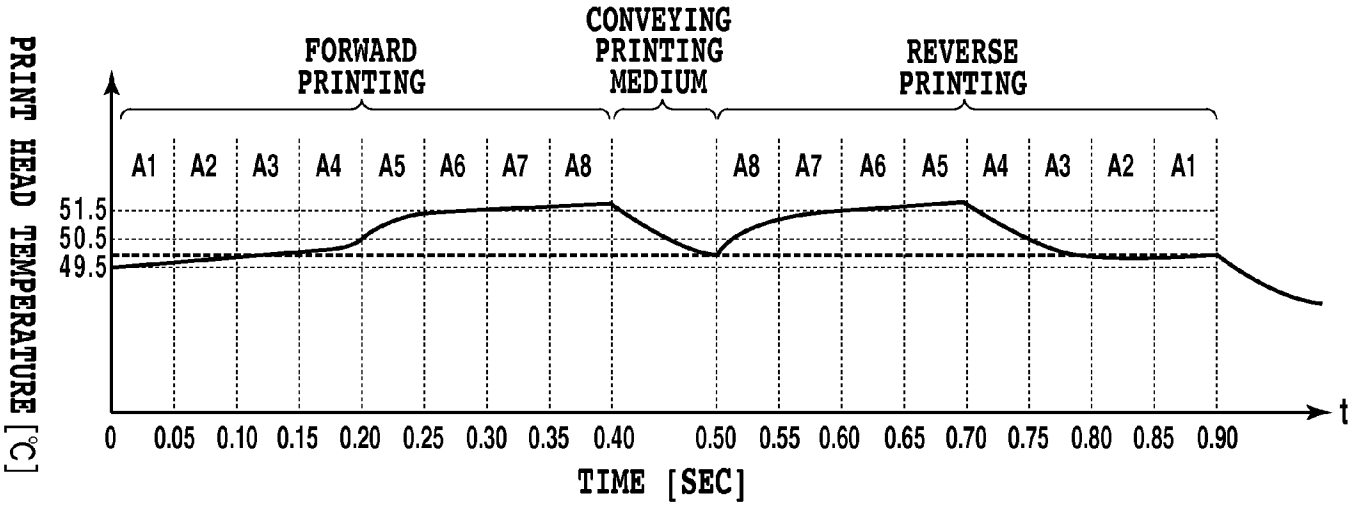
FIG. 20A is a graph for explaining the shift in the temperature of the print head for the third embodiment of the present invention.
Figure 20B:
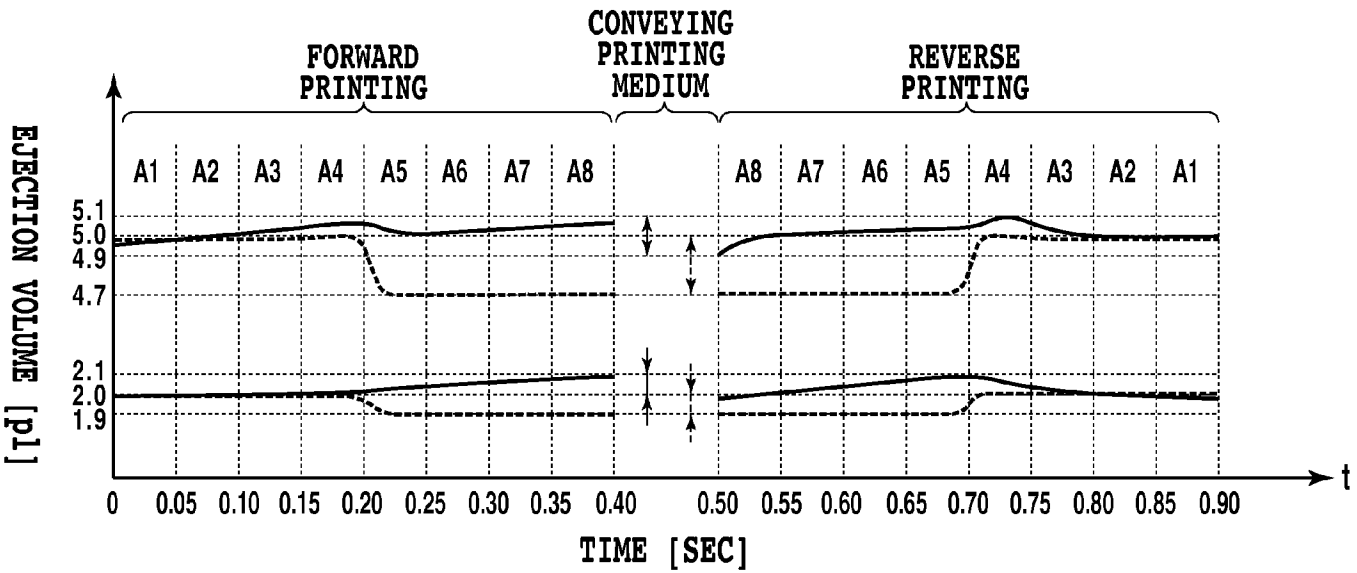
FIG. 20B is a graph for explaining the shift in the ejection volume of ink ejected by the print head in the third embodiment.

During the period from the start of the forward print scan until the end of the backward print scan, the temperature of the print head is changed as shown in FIG. 20A, and the ejection volume of ink is changed as shown in FIG. 20B. The solid lines in FIGS. 20A and 20B indicate shifts in the temperature and the ejection volumes in this embodiment, and dotted lines indicate shifts in the temperature and the ejection volumes for a comparison example wherein the temperature of the print head is adjusted so as always to be 50° C.

In FIG. 20A, the temperature of the print head in this embodiment fluctuates more, within a range of 2° C. or greater, than that in the comparison example. In FIG. 20B, the 5-pl ink ejection in the comparison example has a fluctuation of 0.3 pl and the 2-pl ink ejection has a fluctuation of 0.1 pl, while the 5-pl ink ejection in this embodiment has a fluctuation of 0.2 pl, and 2-pl ink ejection pl has a fluctuation of 0.1 pl. That is, the 5-pl ink ejection in this embodiment has a smaller variance than in the comparison example. As explained in the second embodiment while referring to FIG. 15, in order to maintain the temperature of ink around the ejection ports, the appropriate temperature for the print head differs depending on the sizes of the ejection ports. Therefore, it is difficult for the fluctuation in the ejection of 5-pl ink and the fluctuation in the ejection of 2-pl ink to be eliminated by controlling the print head at a single temperature. However, when the fluctuation in the ejection of 5-pl ink which tends to affect image printing is eliminated, a greater printing density can obtained than in the comparison example.

As described above, in the embodiment, when ejection ports having different sizes are employed to print an image, the ejection number of ink ejected through the small ejection port is multiplied by a predetermined coefficient (temperature coefficient), and the obtained value is added to the ejection number of ink ejected through the large ejection port. The total value is then employed to control the temperature of the print head. With this simple arrangement, fluctuation in the ejection volume of ink can be prevented, and high quality image printing can be performed at an even greater printing density.

Other Embodiment

The preset invention can be applied for a great variety of inkjet printing apparatuses that employ print head that eject ink through ejection port based on print data, and print an image on a printing medium. Therefore, not only a serial printer described above, but also a so-called line printer may be employed. Furthermore, instead of an electro-thermal converting element (heater) described above, a piezoelectric element may be employed to generate the energy to eject ink.

In the above described embodiments, the temperature of the print head can be detected based on a signal output by the temperature detector (diode sensor) provided for the print head. However, an arbitrary temperature detection method can be employed, so long as the temperature of a print head can be detected directly or indirectly. Furthermore, in the above embodiments, the heating unit (sub-heater) is mounted on the print head and is driven to heat the print head. However, an arbitrary heating method can be employed, so long as the print head can be heated directly or indirectly. In short, the ejection number of ink to be ejected in a unit printing area should be counted, and the print head should be heated to a target temperature that rises in accordance with the increase of the count value.

In addition, multiple ejection ports providing different ejection volumes of ink in one ejection are not limited to ejection ports for 5-pl and 2-pl of ink, as described above. Ejection ports providing three or more different ejection volumes may be prepared.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-102406, filed Apr. 10, 2008, which is hereby incorporated by reference herein in its entirety.

What is claimed is:

1. An inkjet printing apparatus to print an image on a printing medium comprising:

a print head capable of ejecting ink from a plurality of ejection ports based on print data, the plurality of ejection ports including a plurality of first ejection ports providing a first ejection volume of ink and a plurality of second ejection ports providing a second ejection volume of ink, the second ejection volume being smaller than the first ejection volume;

a temperature detecting unit that detects a temperature of the print head;

a heating unit that heats the print head so that the temperature detected by the temperature detecting unit reaches a target temperature; and a heating control unit that sets the target temperature;

wherein the heating control unit sets the target temperature in consonance with an increase in a total value obtained by adding a first ejection number of ink to be ejected from the first ejection ports to a value obtained by multiplying a predetermined coefficient by a second ejection number of ink to be ejected from the second ejection ports.

2. The inkjet printing apparatus according to claim 1, further comprising a counting unit that counts the first ejection number of ink to be ejected into a unit printing area of the printing medium based on the print data and the second ejection number of ink to be ejected into the unit printing area of the printing medium based on the print data.

3. The inkjet printing apparatus according to claim 1, wherein the heating control unit increases the coefficient as the second ejection number increases.

4. The inkjet printing apparatus according to claim 3, wherein the heating control unit sets the coefficient to be equal to or greater than 1 when the second ejection number is equal to or greater than a predetermined value.

5. The inkjet printing apparatus according to claim 1, wherein the temperature detecting unit detects the temperature of the print head before a print scan begins.

6. The inkjet printing apparatus according to claim 1, wherein the print head includes a detector for outputting, to the temperature detector, a signal corresponding to the temperature of the print head; and a heater for heating the print head under the control of the heating control unit.

7. The inkjet printing apparatus according to claim 1, further comprising:

a moving unit that moves the print head in a main scan direction; and a conveying unit that conveys the printing medium in a sub-scan direction crossing the main scan direction.

* * * * *